US009726418B2

(12) United States Patent
Chou et al.

(10) Patent No.: US 9,726,418 B2
(45) Date of Patent: Aug. 8, 2017

(54) REFRIGERATION DEVICES INCLUDING TEMPERATURE-CONTROLLED CONTAINER SYSTEMS

(71) Applicant: Tokitae LLC, Bellevue, WA (US)

(72) Inventors: Fong-Li Chou, Bellevue, WA (US); Philip A. Eckhoff, Kirkland, WA (US); Lawrence Morgan Fowler, Kirkland, WA (US); William Gates, Medina, WA (US); Jennifer Ezu Hu, Seattle, WA (US); Muriel Y. Ishikawa, Livermore, CA (US); Fridrik Larusson, Seattle, WA (US); Shieng Liu, Bellevue, WA (US); Nathan P. Myhrvold, Medina, WA (US); Nels R. Peterson, Bellevue, WA (US); Clarence T. Tegreene, Mercer Island, WA (US); Maurizio Vecchione, Pacific Palisades, CA (US); Lowell L. Wood, Jr., Bellevue, WA (US); Victoria Y. H. Wood, Livermore, CA (US)

(73) Assignee: Tokitae LLC, Bellevue, WA (US)

( * ) Notice: Subject to any disclaimer, the term of this patent is extended or adjusted under 35 U.S.C. 154(b) by 474 days.

(21) Appl. No.: 14/484,969

(22) Filed: Sep. 12, 2014

(65) Prior Publication Data

US 2015/0143831 A1 May 28, 2015

Related U.S. Application Data

(63) Continuation-in-part of application No. 14/091,831, filed on Nov. 27, 2013, now Pat. No. 9,366,483.

(51) Int. Cl.
*F25B 39/02* (2006.01)
*F25B 49/02* (2006.01)
(Continued)

(52) U.S. Cl.
CPC ..... *F25D 11/025* (2013.01); *F25B 23/006* (2013.01); *F28F 3/14* (2013.01);
(Continued)

(58) Field of Classification Search
CPC .... F25B 39/028; F25B 49/02; F25B 2339/02; F25B 49/022; F25B 49/027; F25B 49/043; F25B 49/046
(Continued)

(56) References Cited

U.S. PATENT DOCUMENTS 4,137,964 A 2/1979 Buckley
4,474,170 A 10/1984 McConnell et al.
(Continued)

FOREIGN PATENT DOCUMENTS

EP 0 098 052 A2 1/1984
WO WO 2011/007162 A1 1/2011
(Continued)

OTHER PUBLICATIONS

U.S. Appl. No. 14/091,831, Eckhoff et al.
(Continued)

*Primary Examiner* — Mohammad M Ali

(57) ABSTRACT

In some embodiments, a refrigeration device includes: walls substantially forming a liquid-impermeable container configured to hold phase change material internal to the refrigeration device; at least one active refrigeration unit including a set of evaporator coils positioned at least partially within the liquid-impermeable container; a unidirectional thermal conductor with a condensing end and an evaporative end, the condensing end positioned within the liquid-impermeable container; a first aperture in the liquid-impermeable container, the first aperture of a size, shape and position to permit the set of evaporator coils to traverse the aperture; a second aperture in the liquid-impermeable container, the
(Continued)

second aperture including an internal surface of a size, shape and position to mate with an external surface of the unidirectional thermal conductor; and one or more walls substantially forming a storage region in thermal contact with the evaporative end of the unidirectional thermal conductor.

43 Claims, 16 Drawing Sheets

(51) Int. Cl.
*F25D 11/02* (2006.01)
*F25B 23/00* (2006.01)
*F28F 3/14* (2006.01)
*F25D 11/00* (2006.01)

(52) U.S. Cl.
CPC ..... *F25B 2500/01* (2013.01); *F25D 11/006* (2013.01); *F28F 2210/02* (2013.01); *F28F 2255/18* (2013.01)

(58) Field of Classification Search
USPC ..... 62/190, 440
See application file for complete search history.

(56) References Cited

U.S. PATENT DOCUMENTS 5,251,455 A 10/1993 Cur et al.
5,497,630 A 3/1996 Stein et al.
5,579,830 A 12/1996 Giammaruti
6,158,833 A * 12/2000 Engler ..... E05G 1/024 109/83
6,308,518 B1 * 10/2001 Hunter ..... F25B 21/02 62/3.3
6,482,332 B1 * 11/2002 Malach ..... C09K 5/066 165/10
6,865,906 B1 * 3/2005 Sabin ..... C09K 5/04 62/457.9
7,134,486 B2 * 11/2006 Santiago ..... B01D 19/0031 165/104.28
8,716,689 B2 5/2014 Chen et al.
2002/0000443 A1 * 1/2002 Hunter ..... B65D 81/3813 220/592.26
2002/0104319 A1 * 8/2002 Paine ..... F25B 17/08 62/4
2011/0016886 A1 * 1/2011 Ghoshal ..... F25B 21/02 62/3.2
2011/0265785 A1 11/2011 Klier et al.
2012/0012804 A1 1/2012 Chen et al.
2012/0111036 A1 * 5/2012 Campbell ..... F25B 25/005 62/115
2012/0192574 A1 8/2012 Ghoshal et al.
2012/0292476 A1 11/2012 Smith et al.
2012/0294407 A1 11/2012 Namba et al.
2013/0019623 A1 1/2013 Jo et al.
2013/0047652 A1 2/2013 Lee et al.
2013/0063854 A1 3/2013 Soffer
2013/0152621 A1 6/2013 Lee et al.
2013/0160476 A1 6/2013 Lee et al.
2013/0160484 A1 6/2013 Lee et al.

FOREIGN PATENT DOCUMENTS

WO WO 2013/110957 A2 8/2013
WO WO 2013/165535 A1 11/2013

OTHER PUBLICATIONS

PCT International Search Report; International App. No. PCT/US2014/067273; bearing a date of Apr. 24, 2015; pp. 1-3.
PCT International Search Report; International App. No. PCT/US2016/030658; Aug. 11, 2016; pp. 1-3.

* cited by examiner

REFRIGERATION DEVICES INCLUDING TEMPERATURE-CONTROLLED CONTAINER SYSTEMS

CROSS-REFERENCE TO RELATED APPLICATIONS

The present application claims the benefit of the earliest available effective filing date(s) from the following listed application(s) (the "Priority Applications"), if any, listed below (e.g., claims earliest available priority dates for other than provisional patent applications or claims benefits under 35 USC §119(e) for provisional patent applications, for any and all parent, grandparent, great-grandparent, etc. applications of the Priority Application(s)).

PRIORITY APPLICATIONS

The present application constitutes a continuation-in-part of U.S. patent application Ser. No. 14/091,831, entitled TEMPERATURE-CONTROLLED CONTAINER SYSTEMS FOR USE WITHIN A REFRIGERATION DEVICE, naming Philip A. Eckhoff; Lawrence Morgan Fowler; William Gates; Jennifer Ezu Hu; Muriel Y. Ishikawa; Nathan P. Myhrvold; Nels R. Peterson; Clarence T. Tegreene; Maurizio Vecchione; Lowell L. Wood, Jr.; and Victoria Y. H. Wood as inventors, filed 27 Nov. 2013, which is currently co-pending.

If an Application Data Sheet (ADS) has been filed on the filing date of this application, it is incorporated by reference herein. Any applications claimed on the ADS for priority under 35 U.S.C. §§119, 120, 121, or 365(c), and any and all parent, grandparent, great-grandparent, etc. applications of such applications, are also incorporated by reference, including any priority claims made in those applications and any material incorporated by reference, to the extent such subject matter is not inconsistent herewith.

If the listings of applications provided above are inconsistent with the listings provided via an ADS, it is the intent of the Applicant to claim priority to each application that appears in the Domestic Benefit/National Stage Information section of the ADS and to each application that appears in the Priority Applications section of this application.

All subject matter of the Priority Applications and of any and all applications related to the Priority Applications by priority claims (directly or indirectly), including any priority claims made and subject matter incorporated by reference therein as of the filing date of the instant application, is incorporated herein by reference to the extent such subject matter is not inconsistent herewith.

SUMMARY

In some embodiments, a refrigeration device includes: one or more walls substantially forming a liquid-impermeable container, the container configured to hold phase change material internal to the refrigeration device; at least one active refrigeration unit including a set of evaporator coils, the evaporator coils positioned at least partially within the liquid-impermeable container; a unidirectional thermal conductor with a condensing end and an evaporative end, the condensing end positioned within the liquid-impermeable container; a first aperture in the liquid-impermeable container, the first aperture of a size, shape and position to permit the at least one set of evaporator coils to traverse the aperture; a second aperture in the liquid-impermeable container, the second aperture including an internal surface of a size, shape and position to mate with an external surface of the unidirectional thermal conductor; and one or more walls substantially forming a storage region, at least one of the one or more walls in thermal contact with the evaporative end of the unidirectional thermal conductor.

In some embodiments, a refrigeration device includes: one or more walls substantially forming a first liquid-impermeable container, the container configured to hold phase change material internal to the refrigeration device; a first active refrigeration system including at least one first set of evaporator coils, the first set of evaporator coils positioned at least partially within the first liquid-impermeable container; a first aperture in the liquid-impermeable container, the first aperture of a size, shape and position to permit the at least one first set of evaporator coils to traverse the aperture; a unidirectional thermal conductor with a condensing end and an evaporative end, the condensing end positioned within the liquid-impermeable container; a second aperture in the liquid-impermeable container, the second aperture including an internal surface of a size, shape and position to mate with an external surface of the unidirectional thermal conductor; one or more walls substantially forming a first storage region, at least one of the one or more walls in thermal contact with the evaporative end of the unidirectional thermal conductor; one or more walls substantially forming a second liquid-impermeable container, the container configured to hold phase change material internal to the refrigeration device; a second active refrigeration system including at least one second set of evaporator coils, the second set of evaporator coils positioned at least partially within the second liquid-impermeable container; and one or more walls substantially forming a second storage region, at least one of the one or more walls in thermal contact with the second liquid-impermeable container.

In some embodiments, a refrigeration device includes: one or more walls substantially forming a liquid-impermeable container, the container configured to hold phase change material internal to the refrigeration device; at least one active refrigeration unit including a set of evaporator coils, the evaporator coils positioned at least partially within the liquid-impermeable container; a unidirectional thermal conductor including a hollow interior and an evaporative liquid within the hollow interior, the unidirectional thermal conductor with a condensing end and an evaporative end, the condensing end positioned within the liquid-impermeable container, the evaporative end including a series of angled linear segments each including a higher end and a lower end, wherein the vertical displacement between each higher end and each lower end is within a pressure head of the evaporative liquid; a first aperture in the liquid-impermeable container, the first aperture of a size, shape and position to permit the at least one set of evaporator coils to traverse the aperture; a second aperture in the liquid-impermeable container, the second aperture including an internal surface of a size, shape and position to mate with an external surface of the thermal conductor; and one or more walls substantially forming a storage region, at least one of the one or more walls in thermal contact with the evaporative end of the thermal conductor.

The foregoing summary is illustrative only and is not intended to be in any way limiting. In addition to the illustrative aspects, embodiments, and features described above, further aspects, embodiments, and features will become apparent by reference to the drawings and the following detailed description.

DETAILED DESCRIPTION

Figure 1:
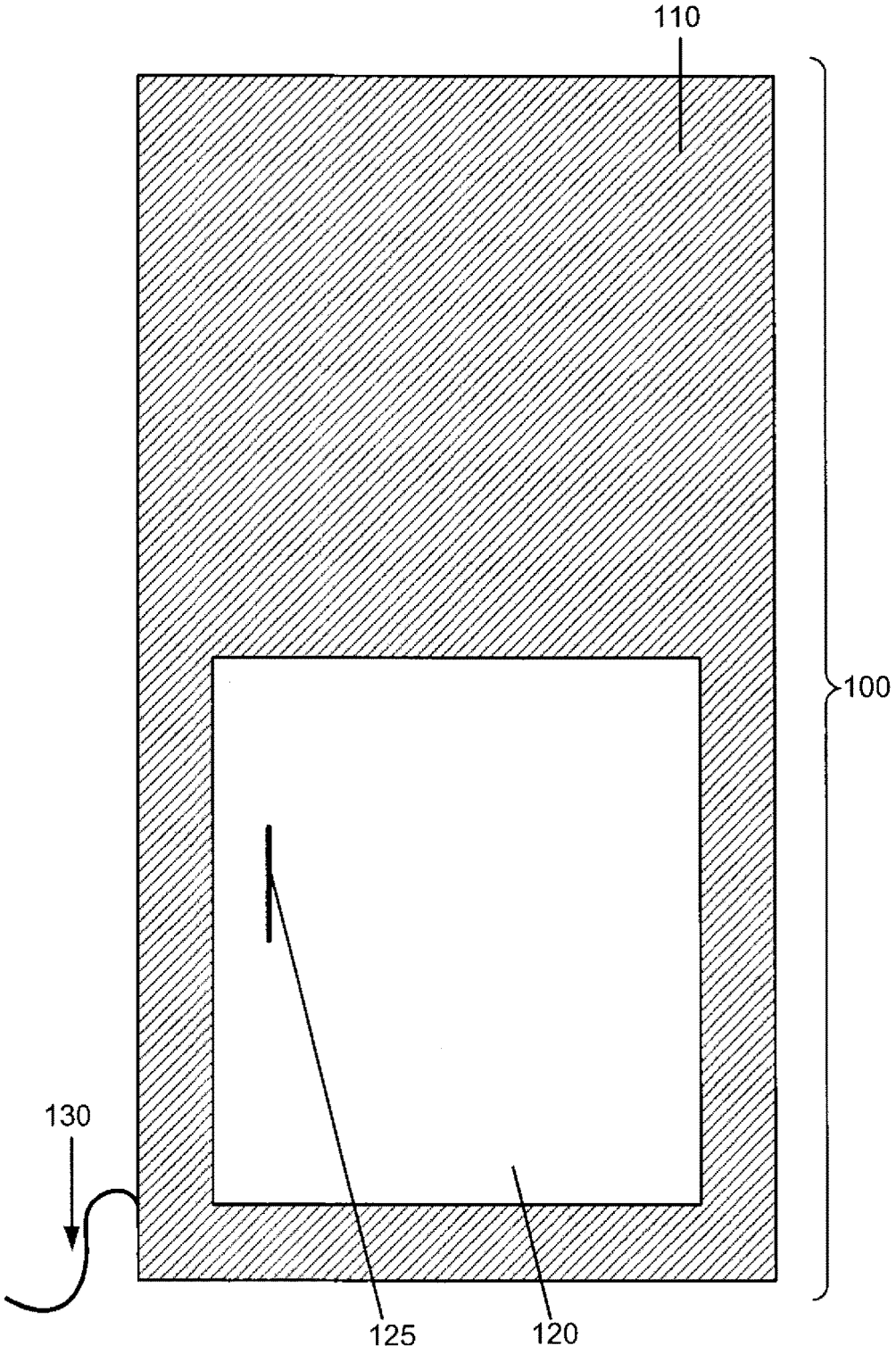
FIG. 1 is a schematic of a refrigeration device.

In the following detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented here.

Aspects of refrigeration devices are described herein. For example, in some embodiments, refrigeration devices are of a size, shape and configuration to be used as a domestic refrigerator device. For example, in some embodiments, refrigeration devices are of a size, shape and configuration for use as a domestic refrigerator appliance. For example, in some embodiments, refrigeration devices are of a size, shape and configuration for use as a commercial refrigerator device. For example, in some embodiments, refrigeration devices are of a size, shape and configuration for use as a medical refrigerator device.

The refrigeration devices described herein are configured to provide ongoing temperature control to at least one storage region within each refrigeration device. The refrigeration devices described herein are designed to provide ongoing temperature control to at least one storage region within the refrigeration devices even in times when a refrigeration device is not able to operate based on the usual power supply, for example during power outages. In particular, it is envisioned that the refrigeration devices described herein will be useful in locations with intermittent or variable power supply to refrigeration devices. For example, in some embodiments, refrigeration devices can be configured to maintain the internal storage region or regions within a predetermined temperature range indefinitely while the refrigeration device has access to electrical power approximately 10% of the time on average. For example, in some embodiments, refrigeration devices can be configured to maintain the internal storage region or regions within a predetermined temperature range indefinitely while the refrigeration device has access to electrical power approximately 5% of the time on average. For example, in some embodiments, refrigeration devices can be configured to maintain the internal storage region or regions within a predetermined temperature range indefinitely while the refrigeration device has access to electrical power approximately 1% of the time on average. For example, in some embodiments, refrigeration devices can be configured to maintain the internal storage region or regions within a predetermined temperature range for at least 30 hours. For example, in some embodiments, refrigeration devices can be configured to maintain the internal storage region or regions within a predetermined temperature range for at least 50 hours. For example, in some embodiments, refrigeration devices can be configured to maintain the internal storage region or regions within a predetermined temperature range for at least 70 hours. For example, in some embodiments, refrigeration devices can be configured to maintain the internal storage region or regions within a predetermined temperature range for at least 90 hours. For example, in some embodiments, refrigeration devices can be configured to maintain the internal storage region or regions within a predetermined temperature range for at least 110 hours. For example, in some embodiments, refrigeration devices can be configured to maintain the internal storage region or regions within a predetermined temperature range for at least 130 hours. For example, in some embodiments, refrigeration devices can be configured to maintain the internal storage region or regions within a predetermined temperature range for at least 150 hours. For example, in some embodiments, refrigeration devices can be configured to maintain the internal storage region or regions within a predetermined temperature range for at least 170 hours.

Items that are sensitive to temperature extremes can be stored within the storage region or regions of refrigeration devices in order to maintain the items within a predetermined temperature range for extended periods, even when power supply to the refrigeration device is interrupted. For example, in some embodiments, a refrigeration device that is unable to obtain power is configured to maintain the temperature of its internal storage region or regions within a predetermined temperature range for an extended period of time when the ambient external temperature is between −10° C. and 43° C. For example, in some embodiments, a refrigeration device that is unable to obtain power is configured to maintain the temperature of its internal storage region or regions within a predetermined temperature range for an extended period of time when the ambient external temperature is between 25° C. and 43° C. For example, in some embodiments, a refrigeration device that is unable to obtain power is configured to maintain the temperature of its internal storage region or regions within a predetermined temperature range for an extended period of time when the ambient external temperature is between 35° C. and 43° C. For example, in some embodiments, a refrigeration device that is unable to obtain power is configured to maintain the temperature of its internal storage region or regions within a predetermined temperature range for at least one week when the ambient external temperature is between −35° C. and 43° C. For example, in some embodiments, a refrigeration device that is unable to obtain power is configured to maintain the temperature of its internal storage region or regions within a predetermined temperature range for at least two weeks when the ambient external temperature is between −35° C. and 43° C. For example, in some embodiments, a refrigeration device that is unable to obtain power is configured to maintain the temperature of its internal storage region or regions within a predetermined temperature range for at least 30 days when the ambient external temperature is between −35° C. and 43° C. For example, in some embodiments, a refrigeration device that is unable to obtain power is configured to maintain the temperature of its internal storage region or regions within a predetermined temperature range for an extended period of time when the ambient external temperature is below −10° C.

As used herein, a "refrigeration device" refers to a device with an internal storage region that utilizes an external power source at least part of the time and is configured to consistently store material at a temperature below ambient temperature for a period of time. In some embodiments, a refrigeration device includes two internal storage regions. In some embodiments, a refrigeration device includes more than two internal storage regions. In some embodiments, a refrigeration device includes two or more internal storage regions, each of the storage regions configured to maintain an internal temperature within a different temperature range. Generally, refrigeration devices include an active refrigeration system. In some embodiments, a refrigeration device is electrically powered from a municipal power supply. In some embodiments, a refrigeration device is powered from a solar power system. In some embodiments, a refrigeration device is powered from a battery. In some embodiments, a refrigeration device is powered from a generator, such as a diesel power generator.

In some embodiments, a refrigeration device is a refrigerator. Refrigerators are generally calibrated to hold internally stored items in a predetermined temperature range above zero but less than potential ambient temperatures. Refrigerators can, for example, be designed to maintain internal temperatures between 1° C. and 4° C. In some embodiments, a refrigeration device is a standard freezer. Freezers are generally calibrated to hold internally stored items in a temperature range below zero but above cryogenic temperatures. Freezers can, for example, be designed to maintain internal temperatures between −23° C. and −17° C., or can, for example, be designed to maintain internal temperatures between −18° C. and −15° C. In some embodiments, a refrigeration device includes both a refrigerator compartment and a freezer compartment. For example, some refrigeration devices include a first internal storage region that consistently maintains refrigerator temperature ranges and a second internal storage region that consistently maintains freezer temperature ranges.

In some embodiments, a refrigeration device is configured to maintain the interior storage region of the refrigeration device within a predetermined temperature range. A "predetermined temperature range," as used herein, refers to a range of temperatures that have been predetermined to be desirable for an interior storage region of a particular embodiment of a refrigeration device in use. A predetermined temperature range is the stable temperature range that an interior storage region of a refrigeration device maintains temperature within during use of the refrigeration device. For example, in some embodiments, a refrigeration device is configured to maintain an interior storage region of the refrigeration device within a predetermined temperature range of approximately 2° C. to 8° C. For example, in some embodiments, a refrigeration device is configured to maintain an interior storage region of the refrigeration device within a predetermined temperature range of approximately 1° C. to 9° C. For example, in some embodiments, a refrigeration device is configured to maintain an interior storage region of the refrigeration device within a predetermined temperature range of approximately −15° C. to −25° C. For example, in some embodiments, a refrigeration device is configured to maintain an interior storage region of the refrigeration device within a predetermined temperature range of approximately −5° C. to −10° C.

For example, in some embodiments, a refrigeration device is configured to maintain an interior storage region of the refrigeration device within the predetermined temperature range for at least 50 hours when power is unavailable to the refrigeration device. For example, in some embodiments, a refrigeration device is configured to maintain an interior storage region of the refrigeration device within the predetermined temperature range for at least 100 hours when power is unavailable to the refrigeration device. For example, in some embodiments, a refrigeration device is configured to maintain an interior storage region of the refrigeration device within the predetermined temperature range for at least 150 hours when power is unavailable to the refrigeration device. For example, in some embodiments, a refrigeration device is configured to maintain an interior storage region of the refrigeration device within the predetermined temperature range for at least 200 hours when power is unavailable to the refrigeration device.

In some embodiments, a refrigeration device is configured to passively maintain its interior storage region or regions within a predetermined temperature range for an extended period of time when power is unavailable to the refrigeration device. In some embodiments, a refrigeration device is configured to maintain its interior storage region or regions within a predetermined temperature range for an extended period of time when minimal electric power is available to the refrigeration device. In some embodiments, a refrigeration device is configured to maintain its interior storage region or regions within a predetermined temperature range for an extended period of time when low-voltage electric power is available to the refrigeration device. In some embodiments, a refrigeration device is configured to maintain its interior storage region or regions within a predetermined temperature range for an extended period of time when variable electric power is available to the refrigeration device. For example, in some embodiments the refrigeration device includes a variable power control system. For example, in some embodiments the refrigeration device includes a battery. In some embodiments the refrigeration device operates passively in the absence of power, and does not include a battery.

With reference now to FIG. 1, shown is an example of a refrigeration device that may serve as a context for introducing one or more processes and/or devices described herein. FIG. 1 depicts a refrigeration device 100 that includes a single storage region internal to the refrigeration device. A single door 120 substantially opens the single storage region of the refrigeration device to outside users of the device. A user of the device can use a handle 125 to open the door 120. The refrigeration device 100 is depicted with the front face of an exterior wall 110 visible. Some embodiments of a refrigeration device can be configured to operate from an electrical power supply, such as a municipal power supply or solar electrical power system. For example, the embodiment of a refrigeration device 100 shown in FIG. 1 includes a power cord 130 to connect with the electrical power supply.

In some embodiments, a refrigeration device includes: one or more walls substantially forming a liquid-impermeable container, the container configured to hold phase change material internal to the refrigeration device; at least one active refrigeration unit including a set of evaporator coils, the evaporator coils positioned at least partially within the liquid-impermeable container; a unidirectional thermal conductor with a condensing end and an evaporative end, the condensing end positioned within the liquid-impermeable container; a first aperture in the liquid-impermeable container, the first aperture of a size, shape and position to permit the set of evaporator coils to traverse the aperture; a second aperture in the liquid-impermeable container, the second aperture including an internal surface of a size, shape and position to mate with an external surface of the unidirectional thermal conductor; and one or more walls substantially forming a storage region, at least one of the one or more walls in thermal contact with the evaporative end of the unidirectional thermal conductor.

Figure 2:
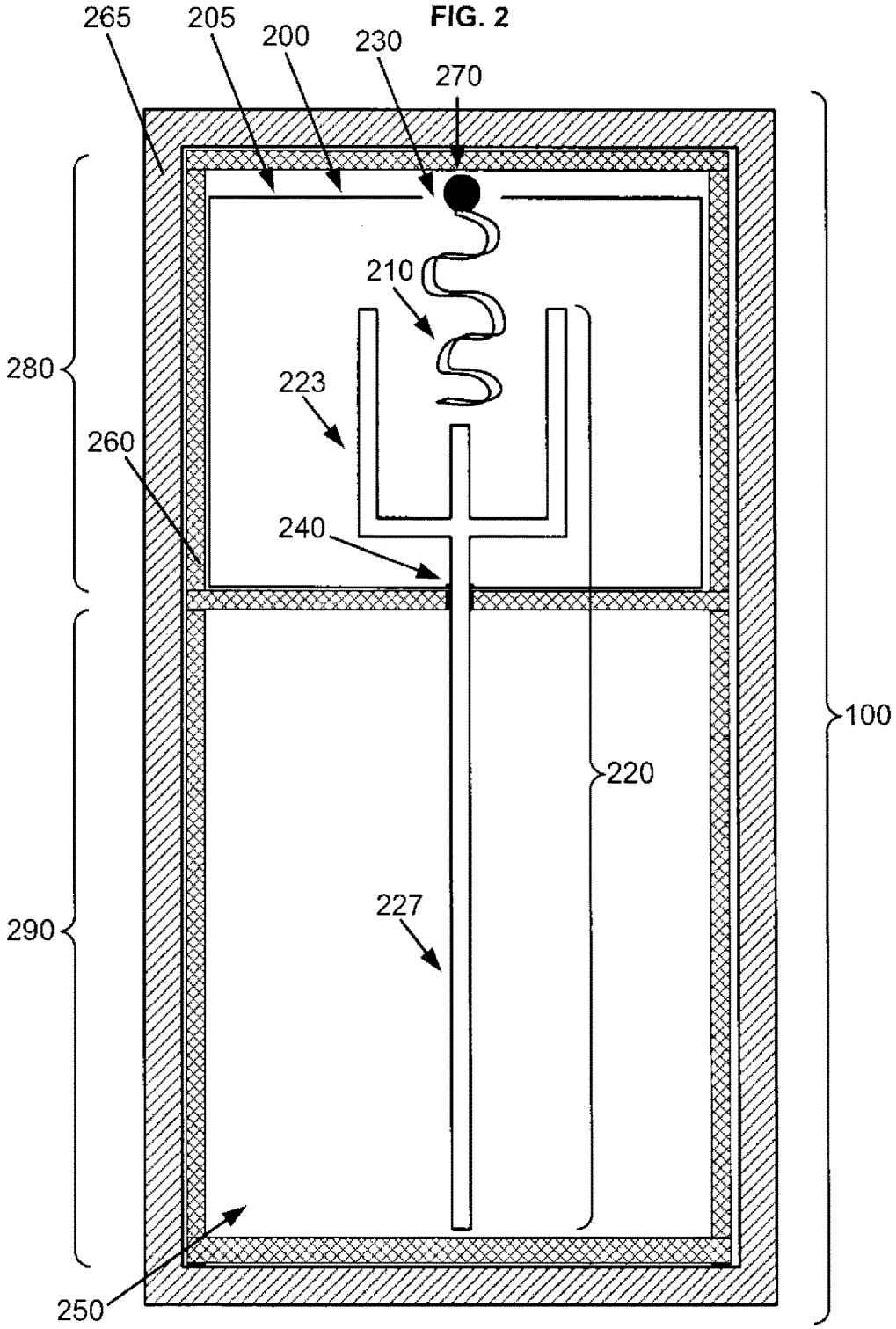
FIG. 2 is a schematic of a refrigeration device.

FIG. 2 depicts a substantially vertical cross-section view of the interior of a refrigeration device 100 for purposes of illustration. The refrigeration device includes an upper region 280, including a liquid-impermeable container 205. The refrigeration device includes a lower region 290, including a thermally-controlled storage region. The refrigeration device includes walls 200 surrounding a liquid-impermeable container 205. The liquid-impermeable container 205 is configured to hold phase change material internal to the refrigeration device. In the embodiment illustrated, the liquid-impermeable container 205 is shaped as a substantially rectangular structure. In some embodiments, a liquid-impermeable container is shaped as a conical or cylindrical structure in order to meet the requirements of the embodiment, such as thermal and size requirements. The liquid-impermeable container has walls with sealed edges as appropriate to the embodiment to maintain a phase change material within the liquid-impermeable container during use of the refrigeration device. In some embodiments, a liquid-impermeable container is fabricated from a durable plastic material. In some embodiments, a liquid-impermeable container is fabricated from a metal material, such as aluminum. In some embodiments, a liquid-impermeable container is fabricated to include an anti-corrosion coating. In some embodiments, a liquid-impermeable container is fabricated to include an anti-galvanic and/or anti-ionization unit. In some embodiments, a liquid-impermeable container includes an access lid within a top surface of the liquid-impermeable container, the access lid configured for a user to access an interior of the liquid-impermeable container. During use, the liquid-impermeable container includes a phase-change material held within the liquid-impermeable container.

A first aperture 230 in the walls 200 of the liquid-impermeable container 205 is positioned at approximately the top center of the liquid-impermeable container 205. A set of evaporator coils 210 traverse the first aperture 230 in the walls 200 of the liquid-impermeable container 205 to position part of the set of evaporator coils 210 within the liquid-impermeable container 205. Some embodiments include two sets of evaporator coils. Some embodiments include more than two sets of evaporator coils. During use, the liquid-impermeable container contains a phase change material, and the set of evaporator coils are in direct contact with the phase change material (see, e.g. FIG. 3). In some embodiments, the majority of the set of evaporator coils are positioned within the interior space of the liquid-impermeable container so that, during use, the majority of an exterior surface of the set of evaporator coils are in direct contact with the phase change material. The direct contact between the exterior surface of the set of evaporator coils and the phase change material promotes thermal conduction between the set of evaporator coils and the phase change material. In some embodiments, the liquid-impermeable container includes thermal transfer structures positioned and configured to enhance thermal conduction within the phase change material. In some embodiments, the refrigeration device includes thermal transfer structures positioned and configured to promote thermal conduction between the phase change material and the set of evaporator coils within the liquid-impermeable container. For example, in some embodiments, the refrigeration device includes one or more thermal fins or similar structures positioned to be in contact with the phase change material. For example, in some embodiments, the refrigeration device includes one or more thermal fins affixed to the set of evaporator coils within the liquid-impermeable container. For example, in some embodiments, the refrigeration device includes one or more thermal fins affixed to the set of evaporator coils at a position outside of the liquid-impermeable container. For example, in some embodiments, the refrigeration device includes one or more thermal fins affixed to a condensing end of a unidirectional thermal conductor within the liquid-impermeable container.

Some embodiments include a set of evaporator coils at least partially within the liquid-impermeable container, and at least partially in thermal contact with the exterior of the liquid-impermeable container. For example, some embodiments include a set of evaporator coils which are partially positioned within the liquid-impermeable container, and partially encircling and affixed to the exterior of the liquid-impermeable container. Some embodiments include two sets of evaporator coils, wherein one set of evaporator coils are positioned at least partially within the liquid-impermeable container, and one set of evaporator coils are positioned adjacent to, and in thermal contact with, the exterior of the liquid-impermeable container.

The set of evaporator coils 210 are part of an active refrigeration unit. In some embodiments, an active refrigeration unit can include a compressor system, including components routinely utilized in such a system. For example, an active refrigeration unit can include one or more sets of evaporation coils, a compressor, and a condenser. In some embodiments, an active refrigeration unit includes a variable speed compressor configured to operate at various levels depending on the input power available to the system. For example, some embodiments include a variable speed compressor that varies the speed of the unit based on a control signal from a controller, wherein the controller send the control signal in response to a variable power input. In some embodiments, an active refrigeration unit can include a thermoelectric unit, such as a Peltier-based device. In some embodiments, an active refrigeration unit can include an absorption cycle cooling system. Some embodiments include one or more sensors integrated into an active refrigeration unit, the one or more sensors positioned and configured to detect the operation parameters of the active refrigeration unit. For example, an active refrigeration unit that includes a compressor system can include one or more pressure sensors, the pressure sensors positioned and configured to detect gas pressure changes within the compressor system. For example, an active refrigeration unit can include one or more power draw, voltage, and/or current sensors positioned and configured to detect the status of the system at any given point in time. The sensors can, for example, be operably attached to a transmitter, a controller, and/or a memory unit. The sensors can, for example, be operably attached to a user interface, such as a graphical display or an indicator light. Some embodiments include one or more sensors operably attached to a controller, wherein the controller includes circuitry configured to adjust operation of the active refrigeration unit in response to information from the sensors. For example, in some embodiments, the controller could send signals to operate, such as changing the speed, of a variable speed compressor. For example, in some embodiments, the controller could send signals to operate a fan positioned to increase air circulation over condenser coils within the active refrigeration unit. A controller including circuitry configured to adjust operation of the active refrigeration unit in response to information from one or more sensors can enhance operation of the refrigeration device, for example by maximizing performance, efficiency and/or durability of the device.

In the embodiment illustrated in FIG. 2, the evaporator coils 210 traverse an aperture 270 in the rear wall of the upper chamber of the refrigeration device. In the embodiment illustrated, other components of the active refrigeration unit are connected to the visible set of evaporator coils and positioned on the reverse side of the rear wall of the upper chamber of the refrigeration device (e.g. not in view in the illustration of FIG. 2).

The embodiment illustrated in FIG. 2 also includes a unidirectional thermal conductor 220 with a condensing end 223 and an evaporative end 227. The condensing end 223 of the unidirectional thermal conductor 220 is positioned within the liquid-impermeable container 205. The walls 200 of the liquid-impermeable container 205 include a second aperture 240. The second aperture 240 includes an internal surface of a size, shape and position to mate with an external surface of the unidirectional thermal conductor 220. In some embodiments, the second aperture in the liquid-impermeable container is positioned substantially within a lower surface of the liquid-impermeable container. In some embodiments, the second aperture in the liquid-impermeable container includes a liquid-impermeable seal positioned between the liquid-impermeable container and the external surface of the thermal conductor traversing the aperture. In some embodiments, one or more sealing structures are positioned between the external surface of the unidirectional thermal conductor and the surface of the second aperture in the liquid-impermeable container. For example, some embodiments can include sealing rings or similar structures positioned between the external surface of the unidirectional thermal conductor and the surface of the second aperture in the liquid-impermeable container. The refrigeration device is configured so that heat from the storage region can be transferred to phase change material in the liquid-impermeable container through the unidirectional thermal conductor, without air transfer between the storage region and other regions of the refrigeration device.

A "unidirectional thermal conductor," as used herein, refers to a structure configured to permit thermal transfer in one direction along its long axis, while substantially inhibiting thermal transfer in the reverse direction along the same long axis. A unidirectional thermal conductor is designed and implemented to encourage the transmission of thermal energy (e.g. heat) in one direction along the length of the unidirectional thermal conductor, while substantially suppressing the transmission in the reverse direction along the length of the unidirectional thermal conductor. In some embodiments, for example, a unidirectional thermal conductor includes a linear heat pipe device. In some embodiments, for example, a unidirectional thermal conductor includes a thermosyphon. In some embodiments, for example, a unidirectional thermal conductor includes a thermal diode device. For example, a unidirectional thermal conductor can include a hollow tube fabricated from a thermally conductive material, the hollow tube sealed at each end and including an evaporative liquid in both a volatile liquid form and in a gas form. For example, a unidirectional thermal conductor can include a tubular structure with a substantially sealed internal region, and an evaporative fluid sealed within the substantially sealed internal region. In some embodiments, for example, a unidirectional thermal conductor is configured as a ½ inch diameter copper pipe. In some embodiments, a unidirectional thermal conductor can be wholly or partially fabricated with a roll-bond technique. In some embodiments, a unidirectional thermal conductor can include an internal geometry positioned and configured to distribute evaporative liquid along the interior surface of the unidirectional thermal conductor. For example, a unidirectional thermal conductor can include an internal surface with grooves, channels, or similar structures of a size, shape and position to distribute evaporative liquid along the internal surface. In some embodiments, a unidirectional thermal conductor can include an interior wick structure throughout the interior or at specific regions of the interior. In some embodiments, a unidirectional thermal conductor can include an interior sintered structure throughout the interior or at specific regions of the interior.

In some embodiments, a unidirectional thermal conductor can include multiple hollow branches, each in vapor connection with each other, each including an evaporative liquid in both a volatile liquid form and in a gas form. Some embodiments include multiple unidirectional thermal conductors. For example, some embodiments include multiple unidirectional thermal conductors arranged in parallel along a single axis. For example, some embodiments include multiple unidirectional thermal conductors utilized in different regions of the refrigeration device, the multiple unidirectional thermal conductors acting independently of each other. Some embodiments include multiple unidirectional thermal conductors including the same evaporative liquid. Some embodiments include multiple unidirectional thermal conductors including different evaporative liquids, for example positioned in different regions of a refrigeration device.

A unidirectional thermal conductor is configured so that the liquid and gas form of the evaporative liquid will be in thermal equilibrium. A unidirectional thermal conductor is substantially evacuated during fabrication, then sealed with a gas-impermeable seal, so that substantially all of the gas present within the unidirectional thermal conductor is the gas form of the liquid present. The vapor pressure within a unidirectional thermal conductor is substantially entirely the vapor pressure of the liquid, so that the total vapor pressure is substantially equivalent to the partial pressure of the liquid. A unidirectional thermal conductor includes an internal flow path for both an evaporative liquid and its vapor. In some embodiments, the unidirectional thermal conductor includes an internal flow path sufficient for two phase flow of the evaporative liquid within the interior of the unidirectional thermal conductor. In some embodiments, a unidirectional thermal conductor can be configured to operate in a substantially vertical position, with thermal transfer from the lower end to the upper end carried out through vapor rising within the unidirectional thermal conductor and condensing at the upper end. In some embodiments, the surface of the evaporative liquid within the unidirectional thermal conductor is positioned to be no higher than the lower face of the wall of the thermally-insulated container. In some embodiments, the unidirectional thermal conductor includes an evaporative liquid wherein the expected surface level of the evaporative liquid is within a storage region of a temperature-controlled container when the unidirectional thermal conductor is in its expected position within the container.

In some embodiments, for example, a unidirectional thermal conductor includes an evaporative liquid that includes one or more alcohols. In some embodiments, for example, a unidirectional thermal conductor includes an evaporative liquid that includes one or more liquids commonly used as refrigerants. In some embodiments, for example, a unidirectional thermal conductor includes water. In some embodiments, for example, a unidirectional thermal conductor includes an evaporative liquid that includes: R-134A refrigerant, iso-butane, methanol, ammonia, acetone, water, isobutene, pentane, or R-404 refrigerant.

Some embodiments include a unidirectional thermal conductor that includes an elongated structure. For example, a unidirectional thermal conductor can include a substantially tubular structure. A unidirectional thermal conductor can be configured as a substantially linear structure. A unidirectional thermal conductor can be configured as a substantially non-linear structure. For example, unidirectional thermal conductor can be configured as a non-linear tubular structure. In some embodiments, one or more thermal conduction units are attached to an exterior surface of a unidirectional thermal conductor. For example, one or more planar structures, such as fin-like structures, fabricated from a thermally-conductive material can be attached to the exterior surface of a unidirectional thermal conductor and positioned to promote thermal transfer between the unidirectional thermal conductor and an adjacent region. A unidirectional thermal conductor can be fabricated from a thermally-conductive metal. For example, a unidirectional thermal conductor can include copper, aluminum, silver or gold.

In some embodiments, a unidirectional thermal conductor can include a substantially elongated structure. For example, a unidirectional thermal conductor can include a substantially tubular structure. The substantially elongated structure includes an evaporative liquid sealed within the structure with gas-impermeable seals. For example, a unidirectional thermal conductor can include welded or crimped gas-impermeable seals. In some embodiments, the evaporative liquid includes one or more of: water, ethanol, methanol, or butane. The selection of the evaporative liquid in an embodiment depends on factors including the evaporation temperature of the evaporative liquid in the particular unidirectional thermal conductor structure in the embodiment, including the gas pressure within the unidirectional thermal conductor. The interior of the structure of the unidirectional thermal conductor includes a gas pressure below the vapor pressure of the evaporative liquid included in that embodiment. When the unidirectional thermal conductor is positioned within a temperature-controlled container in a substantially vertical position, the evaporative liquid evaporates from the lower portion of the unidirectional thermal conductor, wherein the resulting vapor rises to the upper portion of the unidirectional thermal conductor and condenses, thus transferring thermal energy from the lower portion of the unidirectional thermal conductor to the upper portion. In some embodiments, a unidirectional thermal conductor includes a structure including an adiabatic region positioned between the condensing end and the evaporative end, the adiabatic region positioned between the liquid-impermeable container and the storage region of the refrigeration device.

Some embodiments include a unidirectional thermal conductor that is affixed to a thermally-conductive coupling block and a heat pipe. The coupling block and heat pipe can, for example, be positioned and configured to moderate the thermal transfer along the length of the unidirectional thermal conductor.

The unidirectional thermal conductor includes a condensing end and an evaporative end. The condensing end is positioned within the liquid-impermeable container. During use, the condensing end is in direct thermal contact with the phase change material. In some embodiments, the condensing end includes a branched structure. In some embodiments, the condensing end includes a branched structure positioned within the liquid-impermeable container in a positioned relative to the set of evaporator coils to promote thermal transfer between the condensing end, the phase change material, and the set of evaporator coils. In some embodiments, the condensing end includes a branched structure with attached thermal transfer structures, such as fins or plates. In some embodiments, the condensing end includes a branched structure positioned distal from location(s) within the liquid-impermeable container where the phase change material is likely to freeze during use. In some embodiments, the evaporative end includes a branched structure. In some embodiments, the evaporative end includes an evaporative end branched into at least two structural regions, each region including evaporative liquid. In some embodiments, the evaporative end includes an evaporative end branched into at least two structural regions, each region including reservoir structures configured to hold evaporative liquid. In some embodiments, a unidirectional thermal conductor includes a hollow interior and an evaporative liquid within the hollow interior, and wherein the evaporative end includes a series of angled linear segments each including a higher end and a lower end, wherein the vertical displacement between each higher end and each lower end is within a pressure head of the evaporative liquid. In some embodiments, the evaporative end is positioned in direct thermal contact with at least three walls of the one or more walls substantially forming a storage region. In some embodiments, the evaporative end is positioned at an angle less than 90 degrees relative to a lower wall of the storage region.

A refrigeration device includes one or more walls substantially forming a storage region, at least one of the one or more walls in thermal contact with the evaporative end of the unidirectional thermal conductor. For example, in the embodiment illustrated in FIG. 2, the unidirectional thermal conductor 220 includes an evaporative end 227 which is directly affixed to the rear wall 250 of a storage region. Without wishing to be bound by theory, the temperature range within the storage region is thermally controlled through transfer of heat from the interior of the storage region through the unidirectional thermal conductor. In some embodiments, the one or more walls substantially forming a storage region include one or more walls fabricated from a thermally conductive material, at least one of the one or more walls affixed to the evaporative end of the thermal conductor. For example, in some embodiments the one or more walls are fabricated from aluminum. For example, in some embodiments the one or more walls are fabricated from copper.

In some embodiments, a fan is affixed within the storage region, the fan positioned and configured to increase air flow against the evaporative end of the unidirectional thermal conductor. In some embodiments, a fan is affixed within the storage region, the fan operably connected to a controller and configured to operate in response to signals sent by the controller. The controller can, for example, send signals to the fan to turn on in response to a sensor detecting the door to the storage region opening. The controller can, for example, send signals to the fan to turn on in response to a sensor detecting a predetermined temperature within the storage region.

In some embodiments, the one or more walls substantially forming a storage region include a reversibly-closable door positioned and configured to provide access to the storage region for a user of the refrigeration device. See, e.g. the view of FIG. 1. In some embodiments, a refrigeration device includes a door affixed to the storage region, the door positioned and configured to permit a user to access the storage region with minimal heat leakage from the door. In some embodiments, one or more sensors are affixed to the door, the sensor(s) positioned and configured to detect the door opening. In some embodiments, the sensor(s) are positioned and configured to detect the time duration that the door is open. One or more sensors attached to the door can be operably connected to a controller and/or a transmitter unit. One or more sensors attached to the door can be operably connected to a memory unit. One or more sensors attached to the door can be operably connected to a user indicator, such as a graphic display or a light.

In some embodiments, a refrigeration device includes a shell forming an exterior of the refrigeration device around the liquid-impermeable container, the at least one set of evaporator coils, the thermal conductor and the storage region. For example, in the embodiment shown in FIG. 2, a shell 265 surrounds the exterior of the visible components of the refrigeration device. A shell can be fabricated from a rigid material, for example a fiberglass material or a metal such as stainless steel or aluminum. In some embodiments, a refrigeration device includes insulation positioned adjacent to an exterior surface of the storage region. In some embodiments, a refrigeration device includes insulation positioned adjacent to an exterior surface of the liquid-impermeable container. For example, in the embodiment illustrated in FIG. 2, insulation 260 surrounds the exterior of the walls 200 of the liquid-impermeable container 205 and the exterior walls substantially forming a storage region. The insulation can be of a size and shape to reversibly mate with the external surfaces of the walls of the liquid-impermeable container and the exterior walls substantially forming a storage region. The insulation is of sufficient thickness, quality and composition to reduce the heat leak from the storage region to the level where it is substantially balanced by the heat transfer through the unidirectional thermal conductor in a specific embodiment and for the expected use scenarios of that embodiment. For example, in some embodiments the refrigeration device and insulation has a heat leak of approximately 30 W. For example, in some embodiments the refrigeration device and insulation has a heat leak of approximately 25 W. For example, in some embodiments the refrigeration device and insulation has a heat leak of approximately 20 W. For example, in some embodiments the refrigeration device and insulation has a heat leak of approximately 15 W. For example, in some embodiments the refrigeration device and insulation has a heat leak of approximately 10 W. For example, in some embodiments the insulation is fabricated from a foam insulation. For example, in some embodiments the insulation is fabricated from vacuum insulated panels ("VIP").

In some embodiments, a refrigeration device is expected to be used in locations with intermittent power availability, such as due to periodic failure of a municipal power grid or unavailability of solar power. A refrigeration device can include, for example, a battery affixed to the at least one active refrigeration unit. A refrigeration device can be configured to utilize battery power to run the active refrigeration unit conditionally, for example if there is a lack of power for a predetermined period of time (e.g. 2 days, 3 days, or 4 days). A refrigeration device can be configured to utilize battery power to run the active refrigeration unit conditionally, for example if a temperature sensor positioned within the refrigeration device detects a temperature above a predetermined threshold level.

In some embodiments, a refrigeration device is expected to be used in locations with variable power availability, such as a power supply of varying voltages over time. A refrigeration device can include, for example, a variable power control system attached to the at least one active refrigeration unit. In some embodiments, a variable power control system can be designed to accept power from different sources, such as 110, 220 V AC, and 12 to 24 V DC. In some embodiments, a variable power control system can include a power converter. The power converter can, for example, be configured to convert AC input power to DC. The power converter can, for example, be configured to convert variable AC input power to 220 V AC. In some embodiments, a variable power control system includes an automatic voltage regulator. For example, a refrigeration device configured for use in a location with a poorly functioning electrical grid can be configured to accept power in the range of 90 V AC to 250 V AC and covert the input to a steady 220 V AC with an integral automatic voltage regulator. A refrigeration device can include one or more voltage and/or current sensors positioned and configured to detect the power supply to the refrigeration device. The sensors can be attached to a controller, and/or a transmitter unit, and/or a memory unit.

Some embodiments of a refrigeration device are designed to be operational with or without routine electricity from a power grid, such as a municipal power grid. For example, a refrigeration device can be configured to permit operation from a power grid when such is available, and from an alternate power source, such as a photovoltaic unit, at other times. For example, a refrigeration device can be configured to permit operation from a power grid in response to input from a user, and from an alternate power source, such as a photovoltaic unit, in response to other input, such as the availability of solar energy. Some embodiments, for example, include a photovoltaic unit configured to provide power to a battery. Some embodiments, for example, include a photovoltaic unit configured to provide power directly to a refrigeration device. Some embodiments include a photovoltaic unit with a power of 50 Watt (W) peak. Some embodiments include a photovoltaic unit with a power of 100 Watt (W) peak. Some embodiments include a photovoltaic unit with a power of 150 Watt (W) peak. Some embodiments include a photovoltaic unit with a power of 200 Watt (W) peak. Some embodiments are configured to utilize energy from different sources, depending on availability and the preferences of a user. For example, some embodiments include circuitry to accept power from a photovoltaic unit and a controller to direct the accepted power to either the active refrigeration system directly or to a battery. This selection can be directed by a user through an interface, or controlled based on predetermined criteria, such as the time of day, external temperature, or temperature information from one or more temperature sensors within the refrigeration device. Some embodiments include a controller configured to be responsive to the detected conditions of a refrigeration device. Some embodiments include circuitry configured to direct power through a power inverter of 150-200 W surge from a 12 Volt (V) battery to power the existing active refrigeration system of a refrigeration device. Some embodiments are configured to power a thermoelectric unit from the sealed battery under control of the controller in response to information from the temperature sensor within a storage region. For embodiments wherein the interior storage region of the temperature-controlled container is in the 15 liter (L) to 50 L range, a 50 W peak photovoltaic unit should be able to maintain a predetermined temperature range between approximately 2° C. to 8° C. continually with one hour of maximum output from the photovoltaic cell per 24 hour period. The system can also include a charge monitor, configured to ensure that the battery is not depleted below a preset threshold, for example 80% of its charge, to extend the life of the battery during use.

Figure 3:
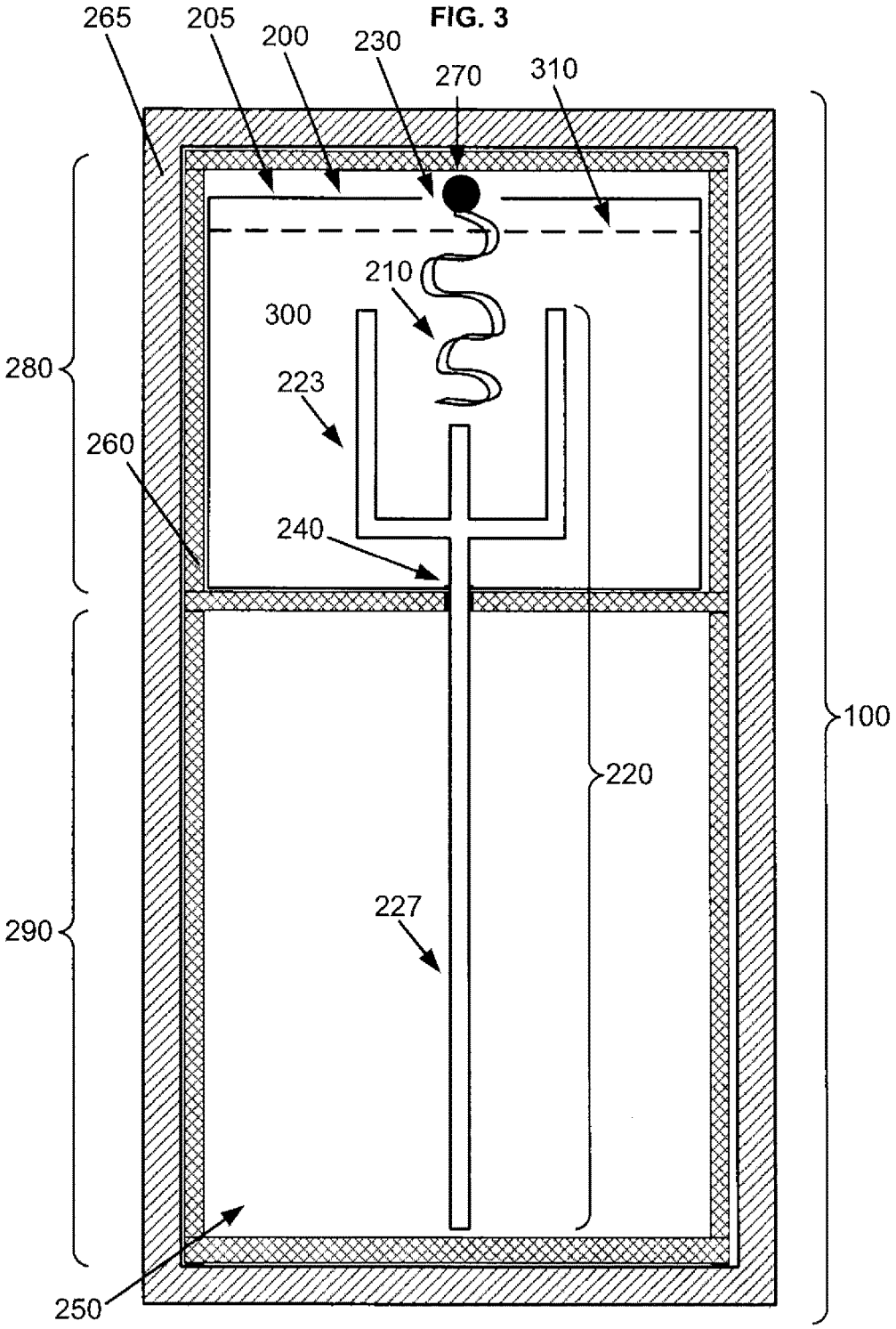
FIG. 3 is a schematic of a refrigeration device.

FIG. 3 illustrates aspects of a refrigeration device in use. As shown in FIG. 3, the liquid-impermeable container 205 includes a phase change material 300. The phase change material 300 substantially fills the liquid-impermeable container 205, with a top surface 310 of the phase change material below the upper wall of the liquid-impermeable container. In some embodiments, a phase change material substantially fills the liquid-impermeable container to approximately 80% of the volume of the container during use. In some embodiments, a phase change material substantially fills the liquid-impermeable container to approximately 85% of the volume of the container during use. In some embodiments, a phase change material substantially fills the liquid-impermeable container to approximately 90% of the volume of the container during use. In some embodiments, a phase change material substantially fills the liquid-impermeable container to approximately 95% of the volume of the container during use.

During use, heat is transferred from the condensing end 223 of the unidirectional thermal conductor 220 into the phase change material 300. The heat is then removed from the phase change material 300 through the set of evaporative coils 210 of the refrigeration unit when the refrigeration unit is operational. In periods when the refrigeration unit is not operational, e.g. a blackout or a period without solar energy, the heat can be transferred into the phase change material to maintain the appropriate temperature of the storage region. Heat from the storage region is transferred directly to the phase change material through the unidirectional thermal conductor, which is in physical contact with the walls of the storage region on the evaporative end and with the phase change material on the condensing end. The phase change material operates, in a sense, as a thermal storage reservoir in times when power is not available to operate the active refrigeration system.

A "phase-change material," as used herein, is a material with a high latent heat, which is capable of storing and releasing heat energy while changing physical phase. The selection of a phase change material for an embodiment depends on considerations including the latent heat for the material, the melting point for the material, the boiling point for the material, the volume of material required to store a predetermined amount of heat energy in an embodiment, the toxicity of the material, the cost of the material, and the flammability of the material. Depending on the embodiment, a phase-change material can be a solid, a liquid, a semi-solid or a gas during use. For example, in some embodiments a phase-change material includes water, methanol, ethanol, a sodium polyacrylate/polysaccharide material or a salt hydrate. In some embodiments, for example, a phase change material including a majority of the volume as pure water/ice is preferred due to the physical property of pure water/ice having a melting point of 0° C. In some embodiments, for example, a phase change material including a majority of the volume as salt water/salt ice is preferred as the melting point of salt ice can be calibrated to below 0° C. based on the salt molarity and content within the salt water/salt ice. In some embodiments, for example, a phase change material is configured to freeze at below −20° C. In some embodiments, for example, a phase change material is configured to freeze at a point between 1° C. and 3° C. In some embodiments, a phase change material is in a liquid form at ambient temperatures (e.g. 25° C.).

Figure 4:
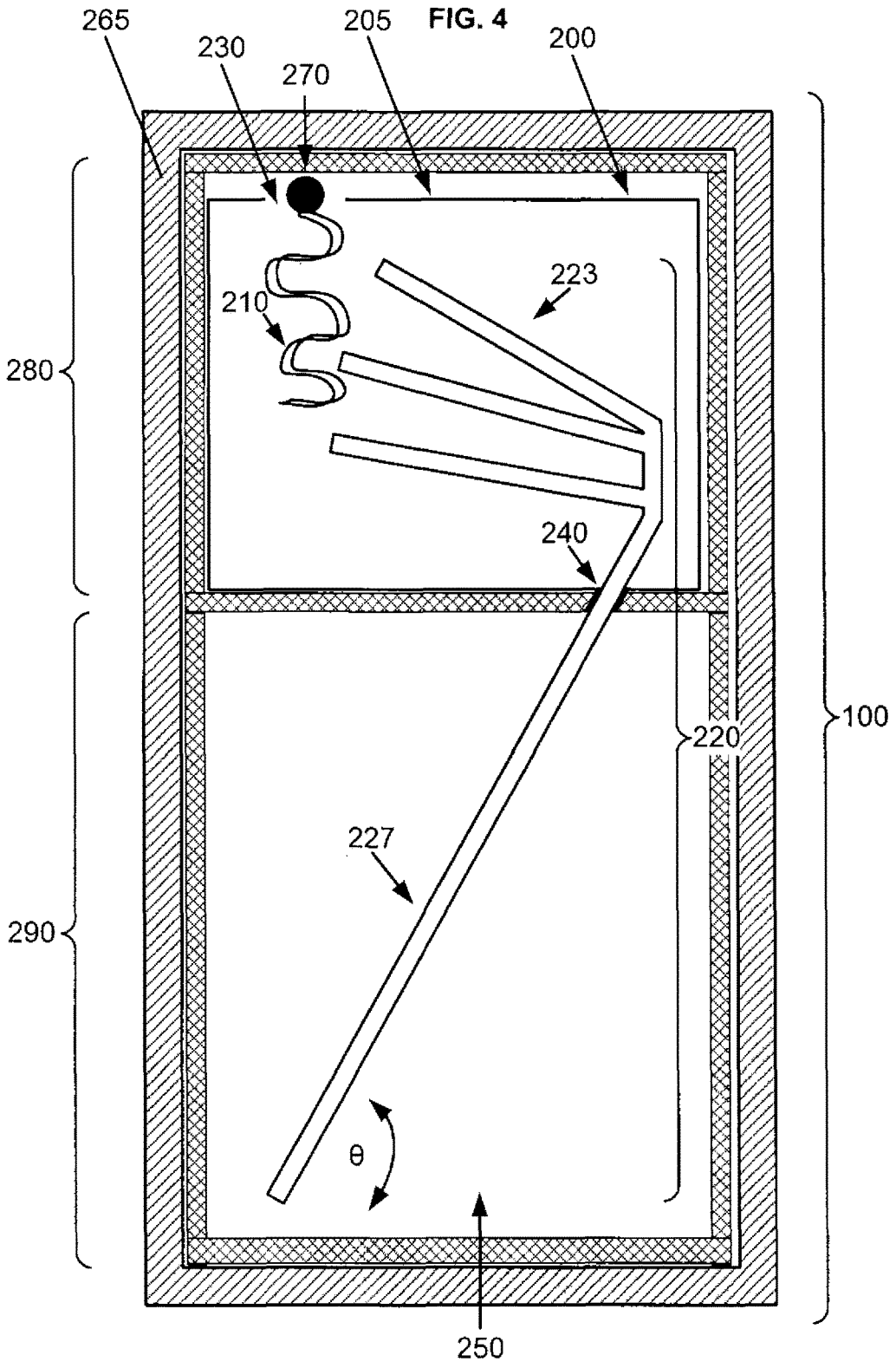
FIG. 4 is a schematic of a refrigeration device.

FIG. 4 illustrates aspects of a refrigeration device 100. The refrigeration device includes a unidirectional thermal conductor 220 with an evaporative end 227 and a condensing end 223. In some embodiments, a refrigeration device includes a unidirectional thermal conductor with an evaporative end positioned at an angle less than 90 degrees relative to a lower wall of the storage region. In the embodiment illustrated, the evaporative end 227 is positioned with its long axis at an angle, denoted as θ, relative to horizontal. In some embodiments, the θ angle of an evaporative end of a unidirectional thermal conductor is 90 degrees. In some embodiments, the θ angle of an evaporative end of a unidirectional thermal conductor is less than 90 degrees. For example, in some embodiments, the θ angle of an evaporative end of a unidirectional thermal conductor is approximately 85 degrees. For example, in some embodiments, the θ angle of an evaporative end of a unidirectional thermal conductor is approximately 80 degrees. For example, in some embodiments, the θ angle of an evaporative end of a unidirectional thermal conductor is approximately 75 degrees. For example, in some embodiments, the θ angle of an evaporative end of a unidirectional thermal conductor is approximately 70 degrees. For example, in some embodiments, the θ angle of an evaporative end of a unidirectional thermal conductor is approximately 65 degrees. For example, in some embodiments, the θ angle of an evaporative end of a unidirectional thermal conductor is approximately 60 degrees. For example, in some embodiments, the θ angle of an evaporative end of a unidirectional thermal conductor is approximately 55 degrees. For example, in some embodiments, the θ angle of an evaporative end of a unidirectional thermal conductor is approximately 50 degrees.

The condensing end 223 of the unidirectional thermal conductor 220 illustrated in FIG. 4 includes a branched structure. The branched structure illustrated includes three distinct end regions, each affixed to a central region. Depending on the embodiment, a branched structure can include two distinct end regions, or more than three distinct end regions. Some embodiments include a unidirectional thermal conductor with a branched structure on the evaporative end. Selection of a branched structure for a unidirectional thermal conductor will depend on the embodiment, for example the thermal properties of a specific unidirectional thermal conductor, the thermal properties of a phase change material used, and the desired target range of the storage region. Some embodiments include one or more thermal conduction elements, such as fins, affixed to the evaporative end of a unidirectional thermal conductor. Some embodiments include one or more thermal conduction elements, such as fins, affixed to the condensing end of a unidirectional thermal conductor.

Figure 5:
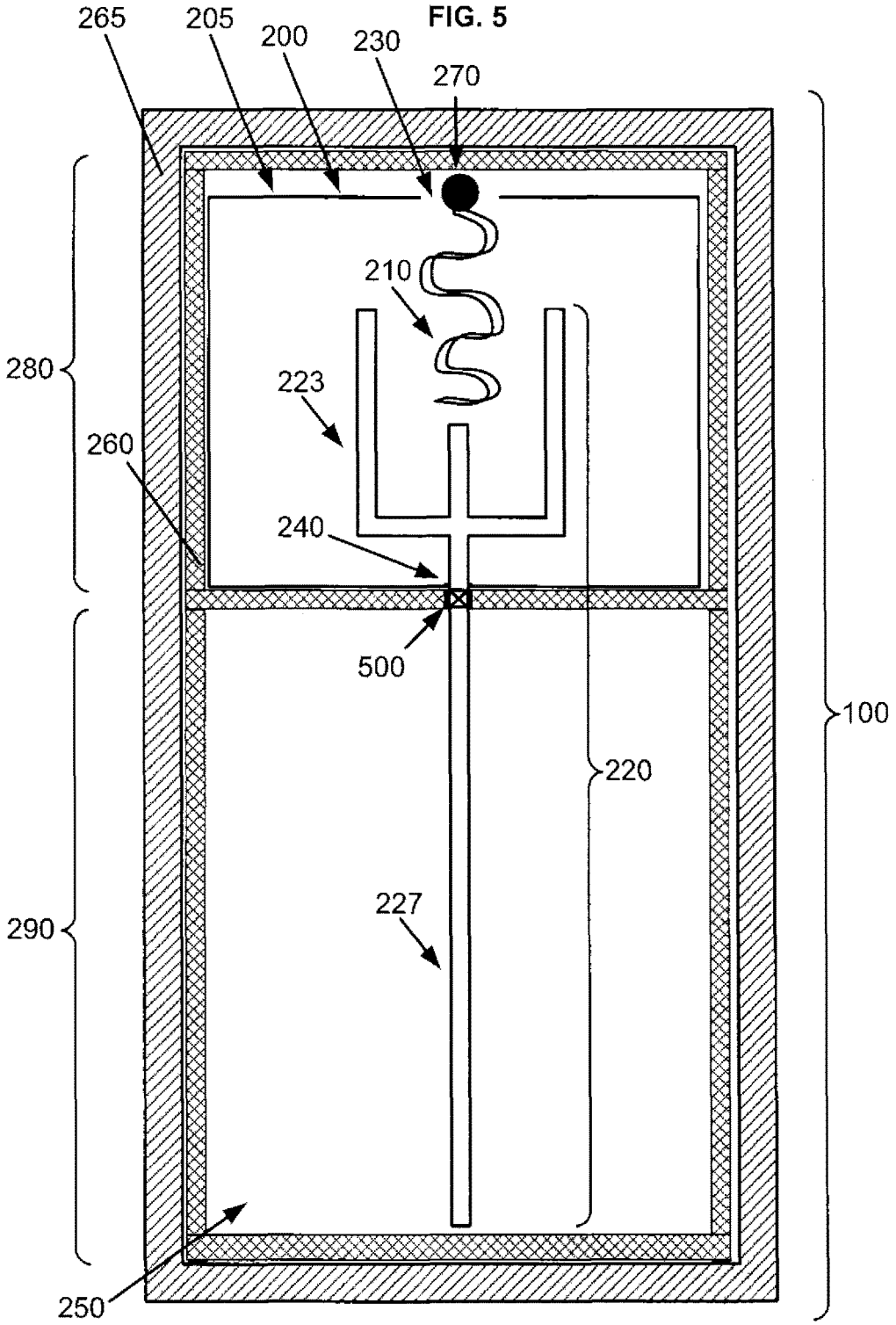
FIG. 5 is a schematic of a refrigeration device.

FIG. 5 depicts a refrigeration device 100 including a unidirectional thermal conductor 220 with an attached thermal control device 500. In the embodiment illustrated, the unidirectional thermal conductor 220 includes an adabatic region positioned between the evaporative end 227 and the condensing end 223 of the unidirectional thermal conductor 220. In the embodiment shown, the thermal control device 500 is affixed to the unidirectional thermal conductor 220 at a position adjacent to a layer of insulation 260 positioned between the liquid-impermeable container 205 and the storage region of the refrigeration device 100. In the embodiment shown, the thermal control device 500 is completely internal to the affixed unidirectional thermal conductor 220.

A "thermal control device," as used herein, is a device positioned and configured to regulate the flow of evaporative liquid, in either liquid or vapor state, through a unidirectional thermal conductor between the evaporative end and the condensing end. A thermal control device changes configuration in response to a stimulus, and thereby alters thermal transfer along the entirety of the attached unidirectional thermal conductor. In some embodiments, a thermal control device operates in a binary state, either opening or closing the flow pathway within the unidirectional thermal conductor. In some embodiments, a thermal control device operates in an analog manner, with multiple possible states opening and closing the flow pathway within the unidirectional thermal conductor to varying levels. For example, a thermal control device can include a valve with multiple partially restricted configurations. For example, a thermal control device can include a valve that can be stably set to positions including 20% restricted flow through the valve, 30% restricted flow through the valve, 40% restricted flow through the valve, 50% restricted flow through the valve, 60% restricted flow through the valve, 70% restricted flow through the valve, and 80% restricted flow through the valve. For example, a thermal control device can include a valve that is a solenoid valve. A thermal control device, through control of evaporative liquid flow, can increase or decrease the thermal energy transferred through a unidirectional thermal conductor. A thermal control device can, for example, be configured to regulate the flow of evaporative liquid, in either liquid or vapor state, through a unidirectional thermal conductor in response to a temperature. In some embodiments, a thermal control device is a passive device. For example a passive thermal control device can include a bimetallic element configured to change position in response to a change in temperature within the unidirectional thermal conductor. In some embodiments, a thermal control device is an active device, such as requiring power to operate and under the active control of a controller. For example, a thermal control element can include an electrically-operable valve internal to the unidirectional thermal conductor, the valve attached to a controller and a power source external to the unidirectional thermal conductor. For example, in some embodiments a thermal control element includes a valve, such as a globe valve, a motor operably connected to the valve and a battery operably connected to the motor. In some embodiments, a thermal control device is entirely internal to the regulated unidirectional thermal conductor. In some embodiments, a thermal control device is partially internal to the regulated unidirectional thermal conductor and partially external to it, for example including one or more power couplings or control features.

In some embodiments, a temperature-controlled container does not include a thermal control device that is a valve within the conduit. In some embodiments, a temperature-controlled container includes a unidirectional thermal conductor that is positioned with a first end within the storage region of the container, and a second end that projects into the phase change material region of the container. An adiabatic region of the unidirectional thermal conductor is positioned within the conduit of the temperature-controlled container. In such embodiments, the temperature-controlled container relies on the temperature gradient across the length of the unidirectional thermal conductor to regulate the temperature within the storage region of the container. For example, a unidirectional thermal conductor can be chosen for a particular embodiment based on its physical properties that alter a thermal gradient along the length of the unidirectional thermal conductor, such as the material used to fabricate the unidirectional thermal conductor, the liquid within the unidirectional thermal conductor, the length of the unidirectional thermal conductor and the diameter of the unidirectional thermal conductor.

Some embodiments include a thermal control device affixed to the unidirectional thermal conductor at a position between the condensing end and the evaporative end. In some embodiments, the thermal control device includes a valve affixed to the unidirectional thermal conductor. In some embodiments, the device also includes a temperature sensor positioned within the storage region, the temperature sensor connected to the thermal control device. In some embodiments, the device also includes a temperature sensor positioned within the liquid-impermeable container, the temperature sensor connected to the thermal control device. Some embodiments include a plurality of temperature sensors connected to a thermal control device.

Figure 6:
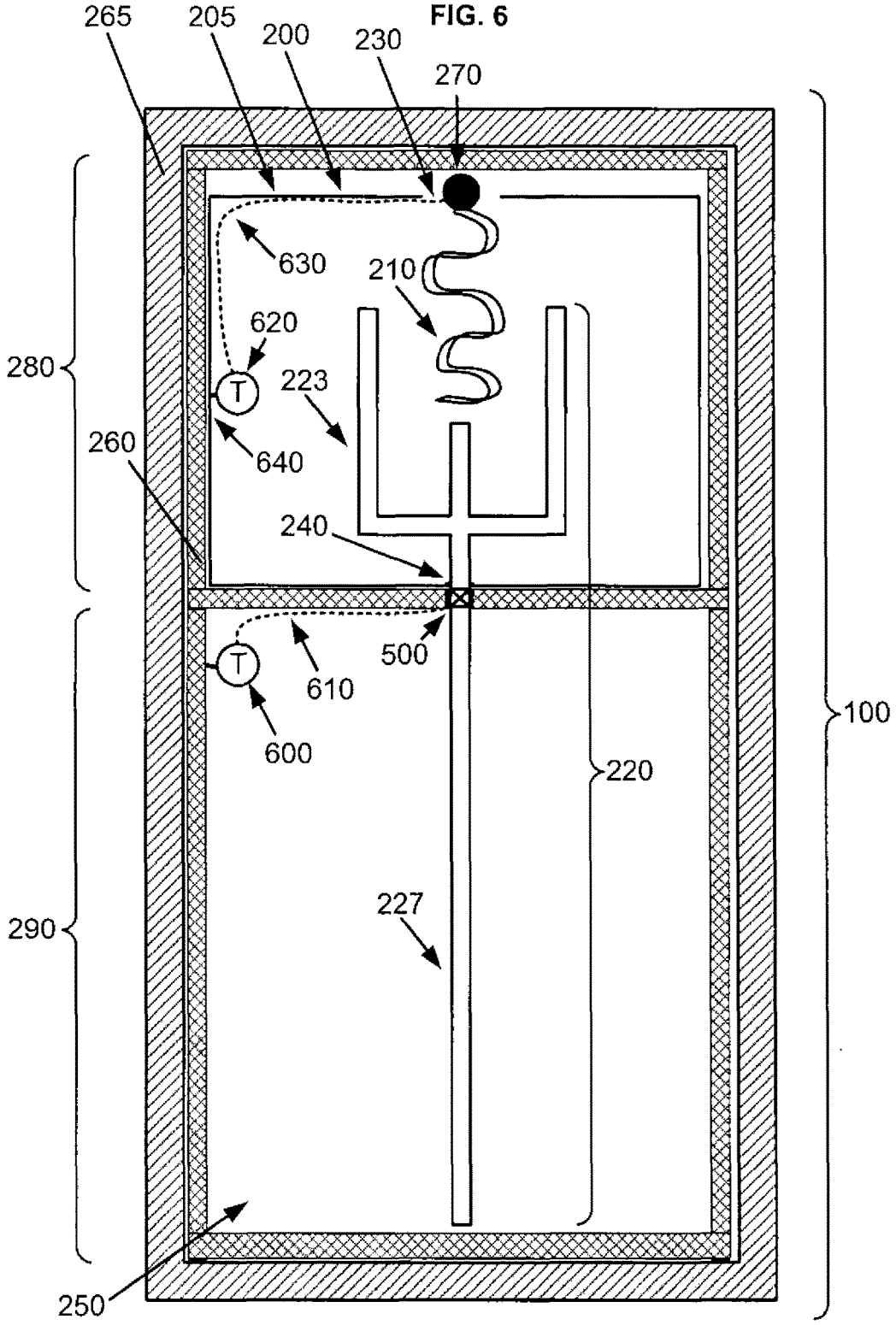
FIG. 6 is a schematic of a refrigeration device.

FIG. 6 depicts a refrigeration device 100 including a unidirectional thermal conductor 220 with an attached thermal control device 500. In the embodiment shown, the thermal control device 500 is affixed to the unidirectional thermal conductor 220 at a position adjacent to a layer of insulation 260 positioned between the liquid-impermeable container 205 and the storage region of the refrigeration device 100. The thermal control device 500 is also attached to a temperature sensor 600 affixed to the interior wall 250 of the storage region of the refrigeration device. In the illustrated embodiment, the thermal control device 500 is attached to the temperature sensor 600 with a wire connector 610. The thermal control device can include an electronic controller, for example an electronic controller that is configured to receive data from the temperature sensor and open and close an attached valve within the unidirectional thermal conductor in response to the received data in comparison with some internal parameters, such as an upper temperature limit and a lower temperature limit. For example, if an embodiment included a storage region with a temperature range between 2° C. and 8° C., an electronic controller might be configured to send a signal to an attached valve to open when the received temperature sensor data indicated a temperature of 6° C., and to send a signal to an attached valve to close when the received temperature sensor data indicated a temperature of 4° C. For example, if an embodiment included a storage region with a temperature range between 1° C. and 9° C., an electronic controller might be configured to send a signal to an attached valve to open when the received temperature sensor data indicated a temperature of 7° C., and to send a signal to an attached valve to close when the received temperature sensor data indicated a temperature of 3° C. For example, if an embodiment included a storage region with a temperature range between 0° C. and 10° C., an electronic controller might be configured to send a signal to an attached valve to open when the received temperature sensor data indicated a temperature of 8° C., and to send a signal to an attached valve to close when the received temperature sensor data indicated a temperature of 2° C.

The embodiment illustrated in FIG. 6 also includes a temperature sensor 620 affixed to an inner wall surface 640 of the liquid-impermeable container 205. In the illustrated embodiment, the temperature sensor is connected to the active refrigeration unit with a wire connector 630. Some embodiments include a temperature sensor positioned within the storage region, the temperature sensor connected to the active refrigeration unit. In some embodiments, an active refrigeration unit includes a controller that operates to send a signal to the compressor system to turn on and off in response to a signal indicating a temperature from a temperature sensor positioned within the liquid-impermeable container. For example, a controller can be configured to turn off the compressor system in response to a received signal from the temperature sensor indicating that the contents of the liquid-impermeable container are below a minimum threshold value. For example, a controller can be configured to turn on the compressor system in response to a received signal from the temperature sensor indicating that the contents of the liquid-impermeable container are below a maximum threshold value.

Figure 7:
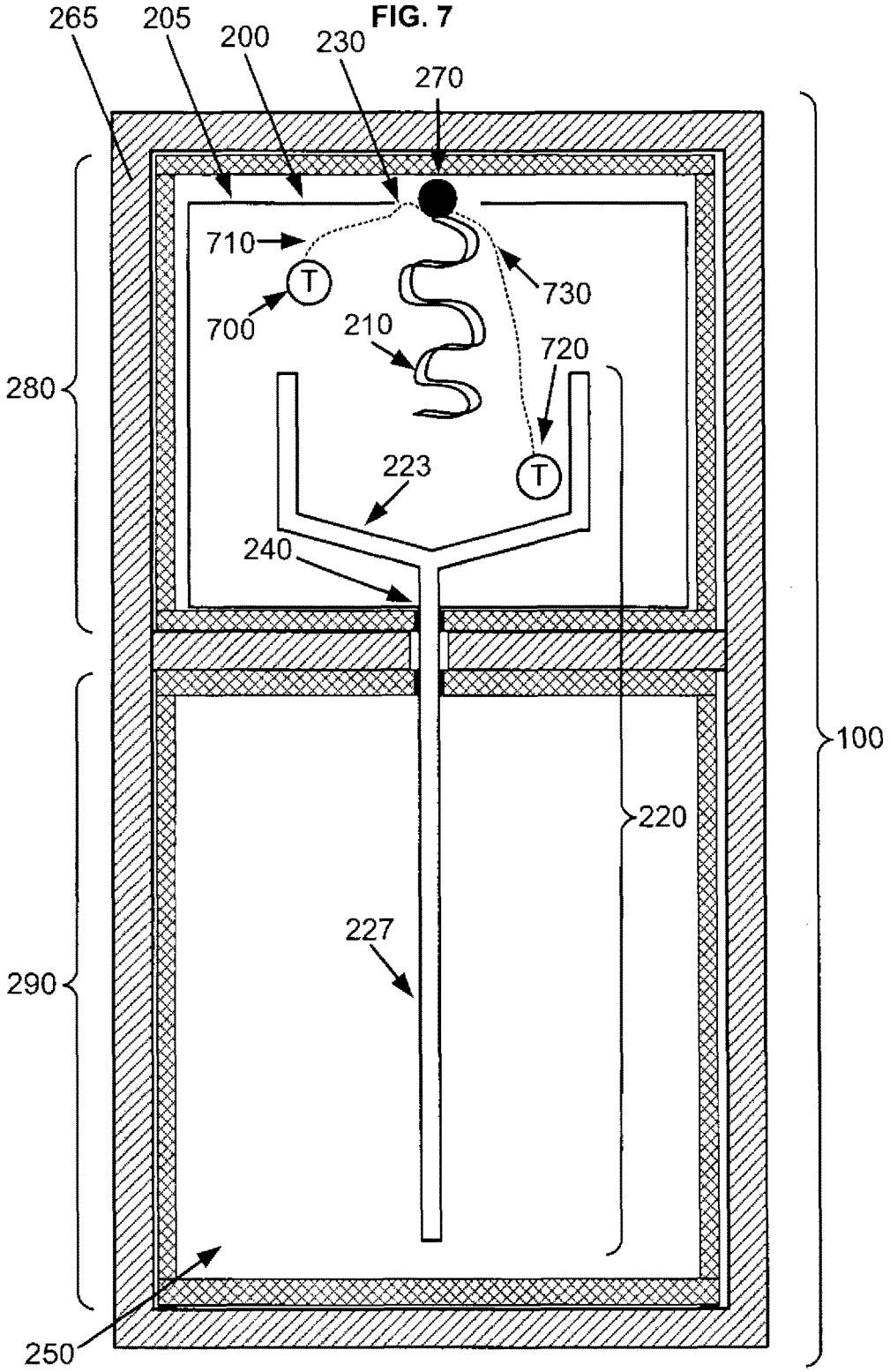
FIG. 7 is a schematic of a refrigeration device.

FIG. 7 illustrates an embodiment including a first temperature sensor 700 positioned within the liquid-impermeable container 205 and connected to the active refrigeration unit with a wire connector 710. The embodiment also includes a second temperature sensor 720 positioned within the liquid-impermeable container 205 and also connected to the active refrigeration unit with a wire connector 720. Some embodiments include wherein the first temperature sensor is positioned relatively distal to the condensing end of the unidirectional thermal conductor, and the second temperature sensor is positioned relatively proximal to the condensing end of the unidirectional thermal conductor. A controller connected to the active refrigeration unit can, for example, give relative weight to the temperature information sent by both the first temperature sensor and the second temperature sensor as part of the control system for the compressor system.

In some embodiments, there are one or more sensors positioned within the liquid-impermeable container and connected to a controller. In some embodiments, the sensors include at least one temperature sensor. In some embodiments, the sensors include at least one fluid level sensor, such as a Hall effect sensor. In some embodiments, the sensors include at least one accelerometer positioned to detect the fluid motion of a phase change material within the liquid-impermeable container. The controller in a refrigeration device can be configured, for example, to detect when a phase change material is freezing within the liquid-impermeable container, and to send a signal to the active refrigeration system to stop or reduce activity of the set of evaporator coils within the liquid-impermeable container in response to the frozen state of the phase change material.

Some embodiments include: one or more walls substantially forming a second liquid-impermeable container, the container configured to hold phase change material internal to the refrigeration device; a second active refrigeration system including at least one second set of evaporator coils, the second set of evaporator coils positioned at least partially within the second liquid-impermeable container; and one or more walls substantially forming a second storage region, at least one of the one or more walls in thermal contact with the second liquid-impermeable container. Some embodiments include: one or more walls substantially forming a second liquid-impermeable container, the container configured to hold phase change material internal to the refrigeration device; a second set of evaporator coils attached to the at least one active refrigeration unit, the second set of evaporator coils positioned at least partially within the second liquid-impermeable container; and one or more walls substantially forming a second storage region, at least one of the one or more walls in thermal contact with the second liquid-impermeable container.

Some embodiments include one or more sensors attached to the refrigeration device, and a transmitter attached to the one or more sensors. For example, a transmitter attached to a temperature sensor affixed to an inner surface of the storage region can be configured to send a signal with temperature data on a regular basis (e.g. hourly, every 2 hours, every 4 hours, every 8 hours, or daily). For example, a transmitter attached to a temperature sensor affixed to an inner surface of the storage region can be configured to send a signal with temperature data in response to a high or low threshold temperature reading (e.g. 1° C. or 9° C.). For example, a transmitter attached to a liquid level sensor positioned within the liquid-impermeable container can be configured to send a signal in response to a low liquid level within the liquid-impermeable container (e.g. due to a leak or similar malfunction).

Figure 8:
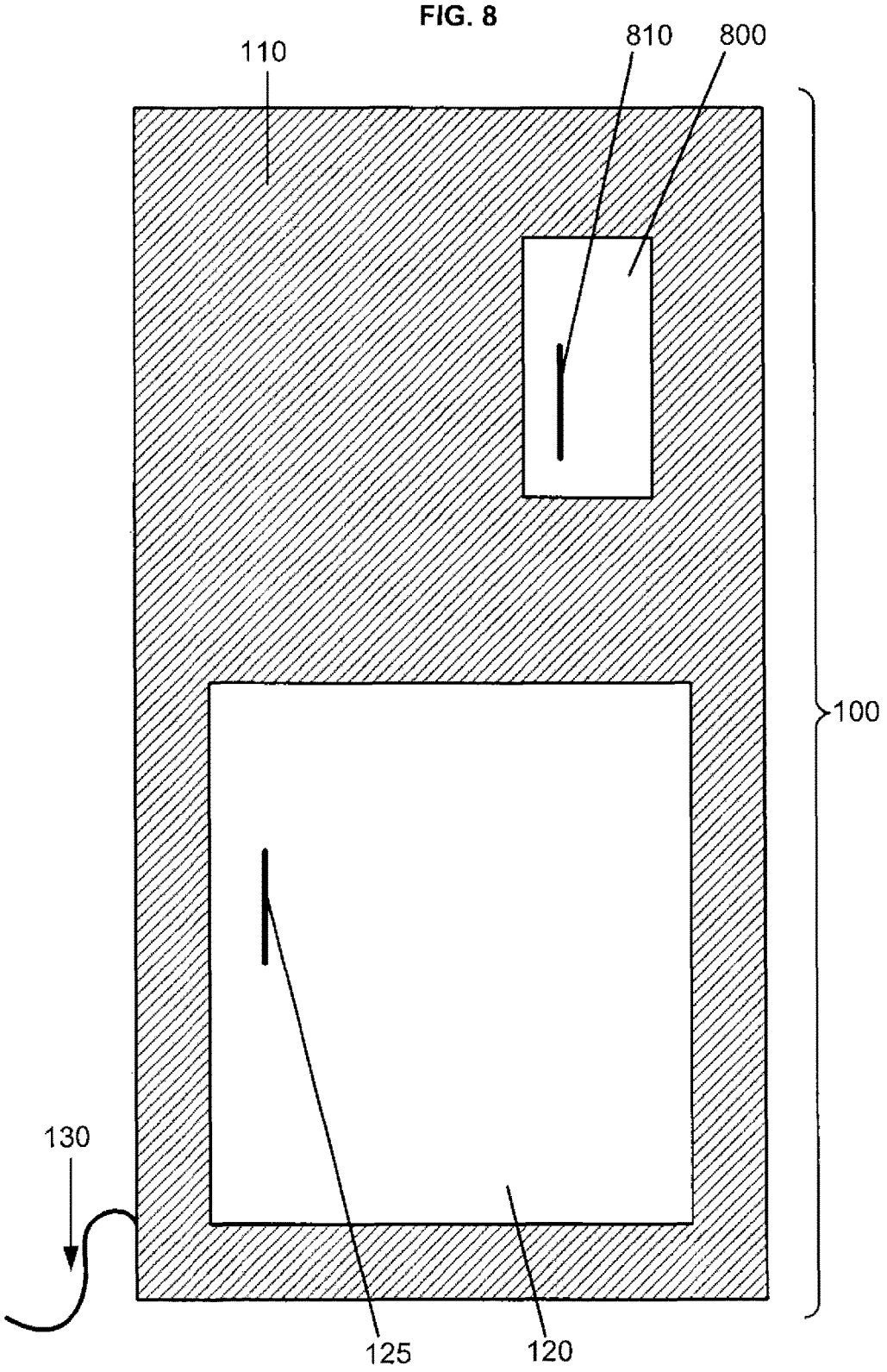
FIG. 8 is a schematic of a refrigeration device.

With reference now to FIG. 8, shown is an example that may serve as a context for introducing one or more processes and/or devices described herein. FIG. 8 depicts a refrigeration device 100 that includes two storage regions internal to the refrigeration device. The refrigeration device 100 is depicted with the front face of an exterior wall 110 visible. The illustrated embodiment of a refrigeration device 100 is configured to operate from an electrical power supply, such as a municipal power supply or solar electrical power, and includes a power cord 130 to connect with the electrical power supply. A first door 120 substantially opens the first storage region of the refrigeration device to outside users of the device. A user of the device can use a handle 125 to open the door 120. A second door 800 substantially opens the second storage region of the refrigeration device to outside users of the device. A user of the device can use a handle 810 to open the door 810.

Some embodiments of a refrigeration device, such as described above, include: one or more walls substantially forming a second storage region; a second unidirectional thermal conductor with a condensing end and an evaporative end, the condensing end positioned within the liquid-impermeable container and the evaporative end positioned in thermal contact with the second storage region; and a third aperture in the liquid-impermeable container, the second aperture including an internal surface of a size, shape and position to mate with an external surface of the second unidirectional thermal conductor.

Figure 9:
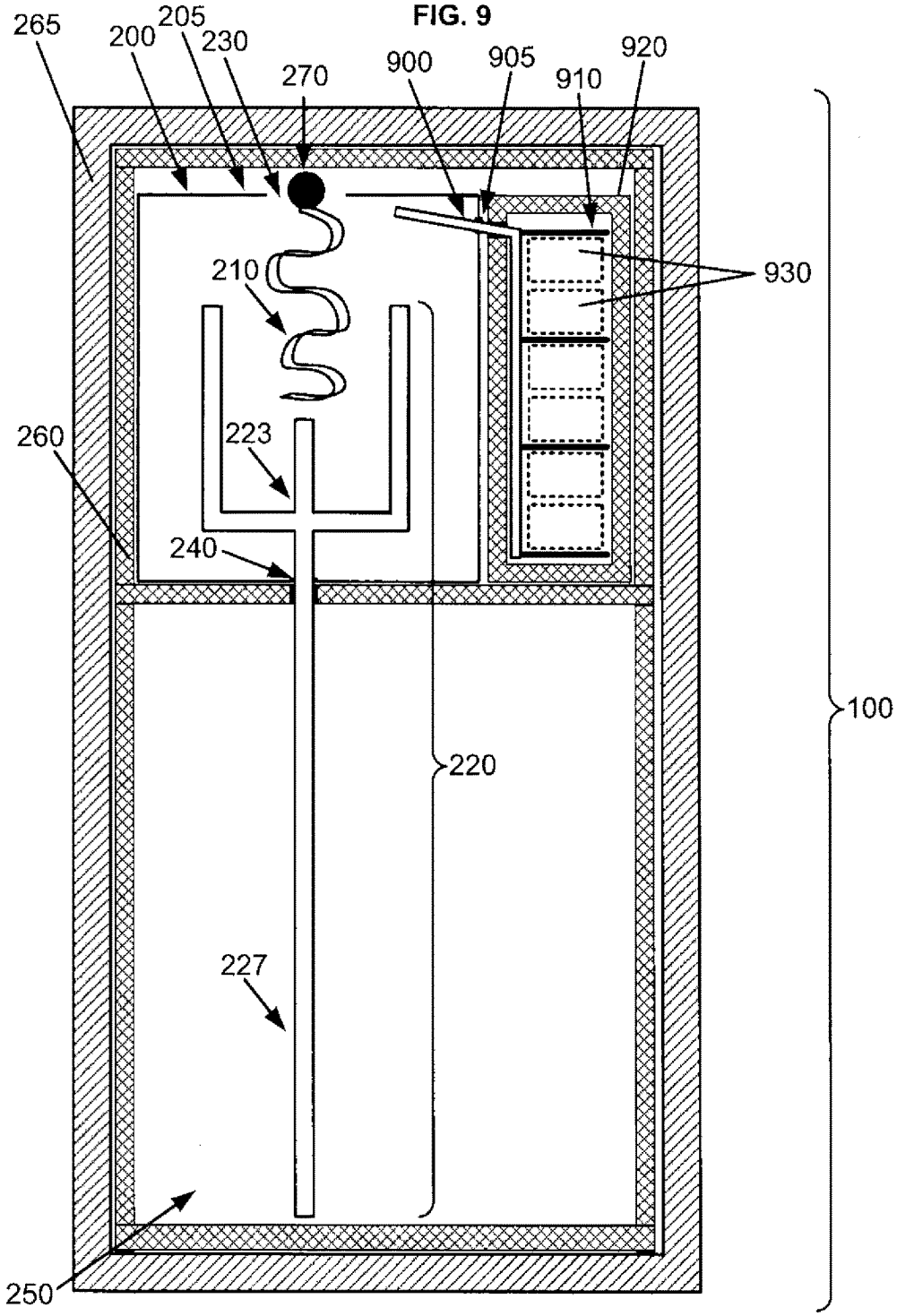
FIG. 9 is a schematic of a refrigeration device.

FIG. 9 depicts a refrigeration device 100 including walls 200 substantially forming a liquid-impermeable container 205, the container 205 configured to hold phase change material internal to the refrigeration device 100. The liquid-impermeable container 205 includes a first aperture 230, the first aperture of a size, shape and position to permit at least one set of evaporator coils 210 to traverse the first aperture 230. The liquid-impermeable container 205 includes a second aperture 240, the second aperture 240 including an internal surface of a size, shape and position to mate with an external surface of a first unidirectional thermal conductor 220. The first unidirectional thermal conductor 220 includes a condensing end 223 positioned within the first liquid-impermeable container 205, and an evaporative end 227 positioned within the first storage region of the refrigeration device 100. The liquid-impermeable container 205 includes a third aperture 905, the third aperture 905 including an internal surface of a size, shape and position to mate with an external surface of a second unidirectional thermal conductor 900. The second unidirectional thermal conductor 900 is in thermal contact with a second storage region.

In the embodiment illustrated in FIG. 9, the external surface of the evaporative end of the second unidirectional thermal conductor 900 has attached thermal conduction elements 910 configured as flat planar structures. The thermal conduction elements 910 are positioned essentially horizontally within the second storage region. In the illustration of FIG. 9, the thermal conduction elements 910 are configured to position ice packs 930 within the second storage region and to enhance thermal transfer between the ice packs 930 and the evaporative end of the second unidirectional thermal conductor 900. The second storage region is surrounded with insulation 920. In some embodiments, the insulation surrounding the second storage region is the same type as that surrounding other regions of the refrigeration device, including the liquid-impermeable container and the first storage region.

Some embodiments of a refrigeration device, such as those described above, include: one or more walls substantially forming a second liquid-impermeable container, the second liquid-impermeable container configured to hold phase change material internal to the refrigeration device; a second unidirectional thermal conductor with a condensing end and an evaporative end, the condensing end positioned within the second liquid-impermeable container and the evaporative end positioned in thermal contact with the second storage region; a second set of evaporator coils affixed to the at least one active refrigeration unit, the second set of evaporator coils positioned at least partially within the second liquid-impermeable container; and one or more walls substantially forming a second storage region, at least one of the one or more walls in thermal contact with the second liquid-impermeable container.

Figure 10:
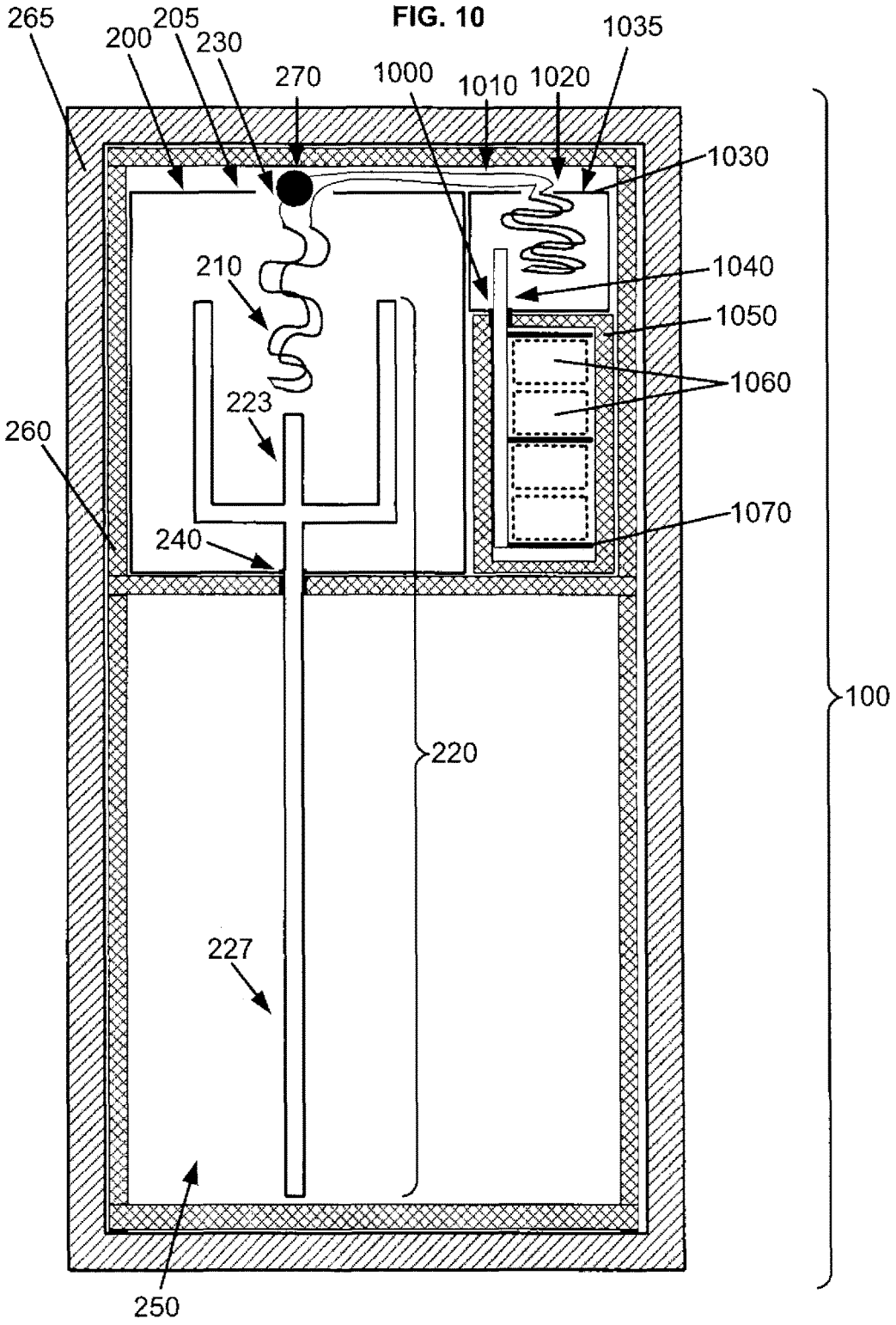
FIG. 10 is a schematic of a refrigeration device.

FIG. 10 illustrates features of an embodiment of a refrigeration device. In the embodiment illustrated, the refrigeration device 100 includes walls 200 substantially forming a first liquid-impermeable container 205, the first liquid-impermeable container 205 configured to hold phase change material internal to the refrigeration device 100, and a first set of evaporator coils 210 attached to an active refrigeration unit, the first set of evaporator coils 210 positioned at least partially within the first liquid-impermeable container 205. The illustrated embodiment includes a first unidirectional thermal conductor 220 with a condensing end 223 and an evaporative end 227, the condensing end 223 positioned within the first liquid-impermeable container 205. The first liquid-impermeable container 205 includes a first aperture 230 of a size, shape and position to permit the first set of evaporator coils 210 to traverse the first aperture 230. The first liquid-impermeable container 205 includes a second aperture 240 including an internal surface of a size, shape and position to mate with an external surface of the first unidirectional thermal conductor 220. The refrigeration device 100 also includes walls 250 substantially forming a first storage region, at least one of the walls 250 in thermal contact with the evaporative end 227 of the first unidirectional thermal conductor 220.

The embodiment illustrated also includes walls 1030 substantially forming a second liquid-impermeable container 1035, the second liquid-impermeable container 1035 configured to hold phase change material internal to the refrigeration device 100. In the embodiment illustrated, the first liquid-impermeable container 205 is larger than the second liquid-impermeable container 1035. In some embodiments, the first liquid-impermeable container and the second liquid-impermeable container are configured to hold the same type of phase change material, e.g. by being fabricated from the same material, and/or including the same types of seals at the joints between the walls. In some embodiments, the first liquid-impermeable container and the second liquid-impermeable container are configured to hold different types of phase change material, e.g. by being fabricated from different material, and/or including different types of seals at the joints between the walls as appropriate to the properties of the phase change materials intended for use in each of the first liquid-impermeable container and the second liquid-impermeable container. The refrigeration device 100 shown includes a second set of evaporator coils 1010 affixed to the active refrigeration unit, the second set of evaporator coils 1010 positioned at least partially within the second liquid-impermeable container 1035. Depending on the embodiment, the first and second sets of evaporator coils can be of the same or of different sizes. The refrigeration device 100 includes a second unidirectional thermal conductor 1040 with a condensing end and an evaporative end, the condensing end positioned within the second liquid-impermeable container 1035. The walls 1030 of the second liquid-impermeable container 1035 include a second aperture 1000, the second aperture 1000 including an internal surface of a size, shape and position to mate with an external surface of the second unidirectional thermal conductor 1040. The evaporative end of the second unidirectional thermal conductor 1040 is positioned in thermal contact with the second storage region through thermal conduction elements 1070 affixed to the exterior surface of the evaporative end of the second unidirectional thermal conductor 1040. The second storage region can include, for example, storage regions of a size and shape to hold one or more ice packs 1060. The ice packs can be, for example, WHO-approved medicinal ice packs configured for medicinal outreach. A second storage region can include, for example, one or more temperature sensors operably attached to a controller.

Some embodiments include a first set of evaporator coils and a second set of evaporator coils attached to a single compressor system, wherein the first set of evaporator coils and the second set of evaporator coils are linked with a valve system, the valve system selectively controlling the activity of the second set of evaporator coils relative to the first set of evaporator coils.

Figure 11:
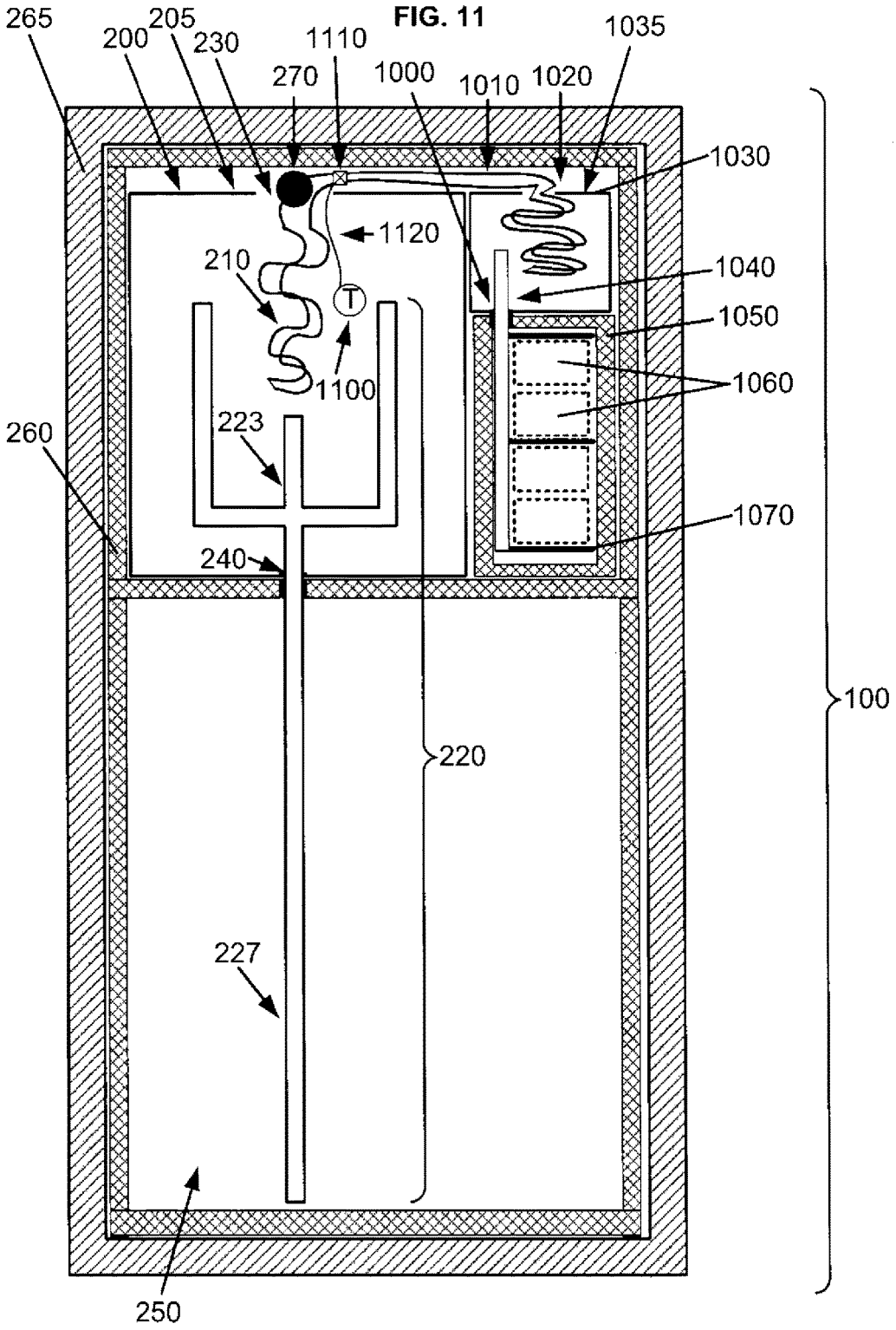
FIG. 11 is a schematic of a refrigeration device.

FIG. 11 depicts a refrigeration device 100 including a first set of evaporator coils 210 and a second set of evaporator coils 1010. The first set of evaporator coils 210 and the second set of evaporator coils 1010 are both linked to a common active refrigeration system. A valve system 1110 is attached to the second set of evaporator coils 1010. A valve system can be configured to selectively regulate the flow of working fluid within the evaporator coils so that thermal transfer within the first liquid-impermeable container and the second liquid-impermeable container are controlled relative to each other. For example, a valve system can include a shunt positioned to selectively return working fluid from the first set of evaporator coils to the rest of the compressor system without passing through the second set of evaporator coils. The valve system can include a controller. The controller can, in some embodiments, receive data from one or more attached sensors, such as temperature sensors, and control the valve system to regulate the flow of working fluid within the evaporator coils in response to the received data. In some embodiments, one or more sensors are operably attached to a valve system with a wireless connection. In some embodiments, one or more sensors are operably attached to a valve system with a wired connection.

In the embodiment shown in FIG. 11, the valve system 1110 is positioned between the first set of evaporator coils 210 and the second set of evaporator coils 1010 to control the relative flow of working fluid within the two sets of evaporator coils. The valve system 1110 is attached to a temperature sensor 1100 affixed to the interior of the first liquid-impermeable container. The temperature sensor 1100 is connected to the valve system 1110 with a wire connector 1120. The valve system 1110 is configured to receive data from the connected temperature sensor 1100 and to regulate the relative flow of working fluid within the two sets of evaporator coils in response to the received data. For example, if the received data indicated that the first liquid-impermeable container has a temperature above a preset limit, the valve system can operate to constrict, retaining working fluid within the first set of evaporator coils. For example, if the received data indicated that the first liquid-impermeable container has a temperature below a preset limit, the valve system can operate to open, increasing the flow of working fluid to the second set of evaporator coils.

In some embodiments, a refrigeration device includes: one or more walls substantially forming a first liquid-impermeable container, the container configured to hold phase change material internal to the refrigeration device; a first active refrigeration system including at least one first set of evaporator coils, the first set of evaporator coils positioned at least partially within the first liquid-impermeable container; a first aperture in the liquid-impermeable container, the first aperture of a size, shape and position to permit the at least one first set of evaporator coils to traverse the aperture; a unidirectional thermal conductor with a condensing end and an evaporative end, the condensing end positioned within the liquid-impermeable container; a second aperture in the liquid-impermeable container, the second aperture including an internal surface of a size, shape and position to mate with an external surface of the unidirectional thermal conductor; one or more walls substantially forming a first storage region, at least one of the one or more walls in thermal contact with the evaporative end of the unidirectional thermal conductor; one or more walls substantially forming a second liquid-impermeable container, the container configured to hold phase change material internal to the refrigeration device; a second active refrigeration system including at least one second set of evaporator coils, the second set of evaporator coils positioned at least partially within the second liquid-impermeable container; and one or more walls substantially forming a second storage region, at least one of the one or more walls in thermal contact with the second liquid-impermeable container.

Figure 12:
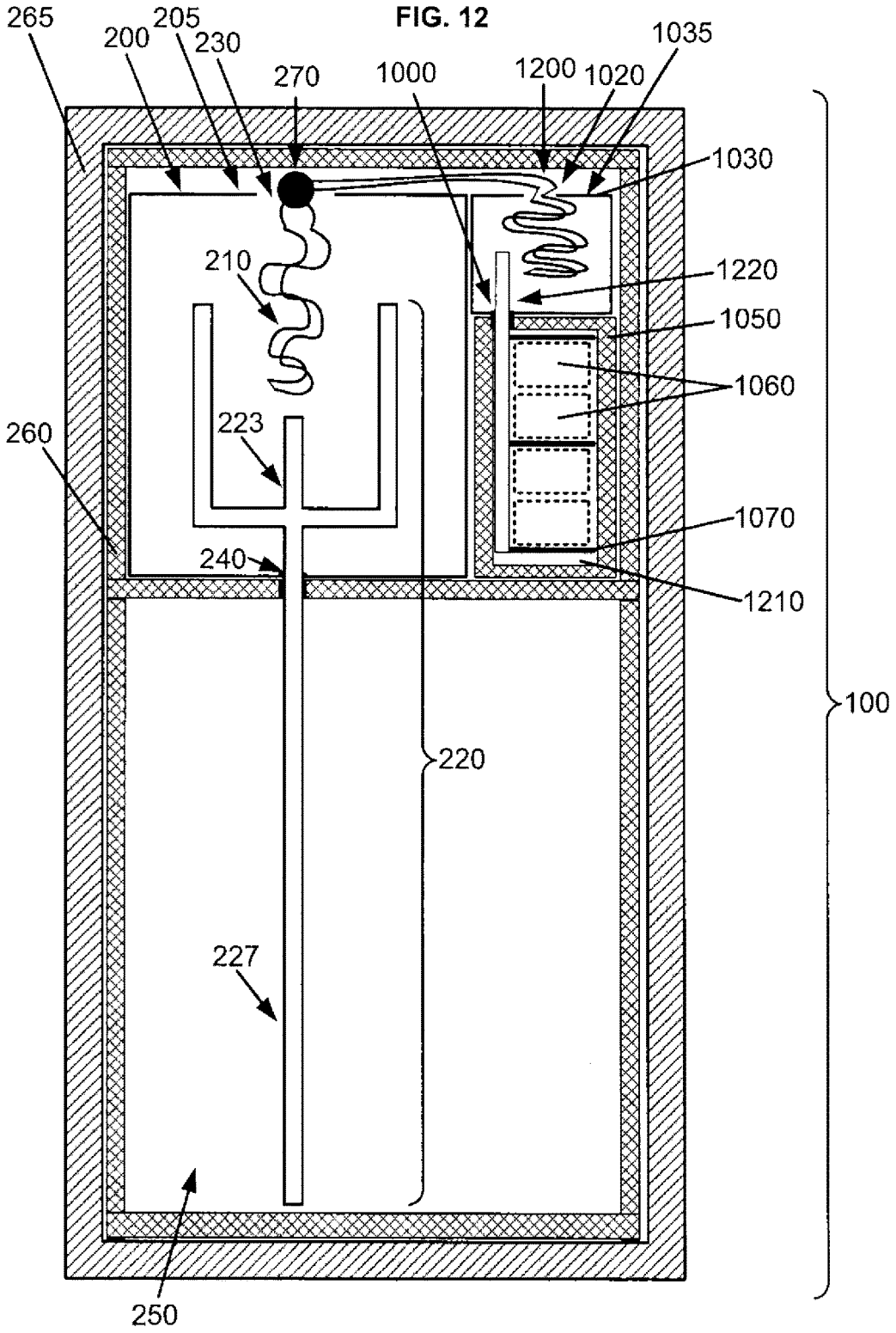
FIG. 12 is a schematic of a refrigeration device.

FIG. 12 illustrates a refrigeration device 100 including walls 200 substantially forming a first liquid-impermeable container 205, the first liquid-impermeable container 205 configured to hold phase change material internal to the refrigeration device 100. The refrigeration device 100 includes a first active refrigeration system including a first set of evaporator coils 210, the first set of evaporator coils 210 positioned at least partially within the first liquid-impermeable container 205. The liquid-impermeable container includes a first aperture 230 of a size, shape and position to permit the first set of evaporator coils 210 to traverse the first aperture 230. The refrigeration device 100 includes a unidirectional thermal conductor 220 with a condensing end 223 and an evaporative end 227, the condensing end 223 positioned within the first liquid-impermeable container 205 and a second aperture 240 in the liquid-impermeable container 205, the second aperture 240 including an internal surface of a size, shape and position to mate with an external surface of the unidirectional thermal conductor 220. The refrigeration device 100 includes one or more walls 250 substantially forming a first storage region, at least one of the walls in thermal contact with the evaporative end 227 of the unidirectional thermal conductor 220. The refrigeration device 100 includes one or more walls 1030 substantially forming a second liquid-impermeable container 1035 configured to hold phase change material internal to the refrigeration device 100. The refrigeration device 100 includes a second active refrigeration system including a second set of evaporator coils 1200. The second set of evaporator coils 1200 is positioned at least partially within the second liquid-impermeable container 1035. The refrigeration device 100 includes walls 1210 substantially forming a second storage region, at least one of the walls 1210 in thermal contact with the second liquid-impermeable container 1035.

In the embodiment illustrated in FIG. 12, the refrigeration device 100 includes walls 1210 substantially forming a second storage region which is in thermal contact with the second liquid-impermeable container through a thermal conduction plate 1220, which is in thermal contact with both the phase change material within the second liquid-impermeable container 1035 and with the walls 1210 of the second storage region. A thermal conduction plate can be fabricated from a thermally conductive material, for example copper or aluminum. In some embodiments, the walls of the second storage region are in thermal contact with the second liquid-impermeable container through a second unidirectional thermal conductor. In some embodiments, a second unidirectional thermal conductor is positioned with a condensing end in contact with the phase change material within the second liquid-impermeable container and an evaporative end in contact with at least one wall of the second storage region. Some embodiments include one or more thermal conduction elements positioned to enhance thermal energy transfer between the second storage region and the second liquid-impermeable container. For example, the embodiment illustrated in FIG. 12 includes thermal conduction elements 1070 affixed to the exterior surface of the thermal conduction plate 1220 at positions within the second storage region. In the embodiment shown in FIG. 12, the spacing between the thermal conduction elements 1070 within the second storage region is also of a position and size to hold a plurality of ice packs 1060. In some embodiments, a temperature sensor is positioned within the second storage region, the temperature sensor operably attached to a controller.

In some embodiments, a refrigeration device includes a first active refrigeration system including a first set of evaporator coils and a second active refrigeration system including a second set of evaporator coils. In some embodiments, the two active refrigeration systems are configured to operate independently. Some embodiments include two active refrigeration systems that operate in parallel and without interaction between the two active refrigeration systems. For example, a first active refrigeration system in a refrigeration device can be configured to operate independently of a second active refrigeration system in the same refrigeration device. In some embodiments, there are two active refrigeration systems that are both connected to a controller. Some embodiments include a refrigeration device with a controller operably connected to both the first active refrigeration system and the second active refrigeration system. In some embodiments, a single controller is configured to switch on and off two active refrigeration systems that are part of the refrigeration device. For example, a controller can be configured to switch on and off both of the active refrigeration systems in response to a predetermined set of criteria. In some embodiments, a first storage region is configured to maintain temperature in a range between 2° C. and 8° C., and a second storage region is configured to maintain temperature in a range between −10° C. and −1° C., and an attached controller is configured to maintain the temperature of the first storage region with priority over the second temperature region in times of reduced power availability. For example, in some embodiments a controller is configured to utilize electrical power preferentially to a first active refrigeration system to operate the attached first set of evaporator coils within a first liquid-impermeable container, and only operate a second active refrigeration system including an attached second set of evaporator coils within a second liquid-impermeable container when power is available in excess of that required to efficiently operate the first active refrigeration system.

In some embodiments, a refrigeration device includes a battery. For example, some embodiments of a refrigeration device include a battery operably attached to a sensor, such as a temperature sensor, positioned within the refrigeration device. For example, some embodiments of a refrigeration device include a battery operably attached to a transmitter. In some embodiments, a refrigeration device includes a battery affixed to the first active refrigeration system and to the second active refrigeration system. For example, a refrigeration device can be configured to include one or more electricity-producing solar panels configured to charge a battery, and wherein the battery is configured to power one or more active refrigeration systems within the refrigeration device. For example, a refrigeration device can be configured to include a diesel generator configured to charge a battery, and wherein the battery is configured to power one or more active refrigeration systems within the refrigeration device.

In some embodiments, a refrigeration device includes a variable power control system attached to the first active refrigeration system and to the second active refrigeration system. For example, a variable power control system can include a controller which is be configured to operate a variable speed compressor system at different speeds in response to variable power availability. For example, a variable power control system can be directly attached to the first active refrigeration system and to the second active refrigeration system. For example, a variable power control system can be attached to a controller, and the controller then attached to the first active refrigeration system and to the second active refrigeration system, and configured to selectively control the first active refrigeration system and the second active refrigeration system, depending on the parameters preset into the circuitry of the controller.

In some embodiments, a refrigeration device includes: one or more walls substantially forming a liquid-impermeable container, the container configured to hold phase change material internal to the refrigeration device; at least one active refrigeration unit including a set of evaporator coils, the evaporator coils positioned at least partially within the liquid-impermeable container; a unidirectional thermal conductor including a hollow interior and an evaporative liquid within the hollow interior, the unidirectional thermal conductor with a condensing end and an evaporative end, the condensing end positioned within the liquid-impermeable container, the evaporative end including a series of angled linear segments each including a higher end and a lower end, wherein the vertical displacement between each higher end and each lower end is within a pressure head of the evaporative liquid; a first aperture in the liquid-impermeable container, the first aperture of a size, shape and position to permit the at least one set of evaporator coils to traverse the aperture; a second aperture in the liquid-impermeable container, the second aperture including an internal surface of a size, shape and position to mate with an external surface of the thermal conductor; and one or more walls substantially forming a storage region, at least one of the one or more walls in thermal contact with the evaporative end of the thermal conductor.

In some embodiments, a refrigeration device includes: one or more walls substantially forming a liquid-impermeable container, the container configured to hold phase change material internal to the refrigeration device; at least one active refrigeration unit including a set of evaporator coils, the evaporator coils positioned at least partially within the liquid-impermeable container; a unidirectional thermal conductor including a hollow interior and an evaporative liquid within the hollow interior, the unidirectional thermal conductor with a condensing end and an evaporative end, the condensing end positioned within the liquid-impermeable container, the evaporative end including a series of angled linear segments each including a higher end and a lower end; a first aperture in the liquid-impermeable container, the first aperture of a size, shape and position to permit the at least one set of evaporator coils to traverse the aperture; a second aperture in the liquid-impermeable container, the second aperture including an internal surface of a size, shape and position to mate with an external surface of the thermal conductor; and one or more walls substantially forming a storage region, at least one of the one or more walls in thermal contact with the evaporative end of the thermal conductor.

Figure 13:
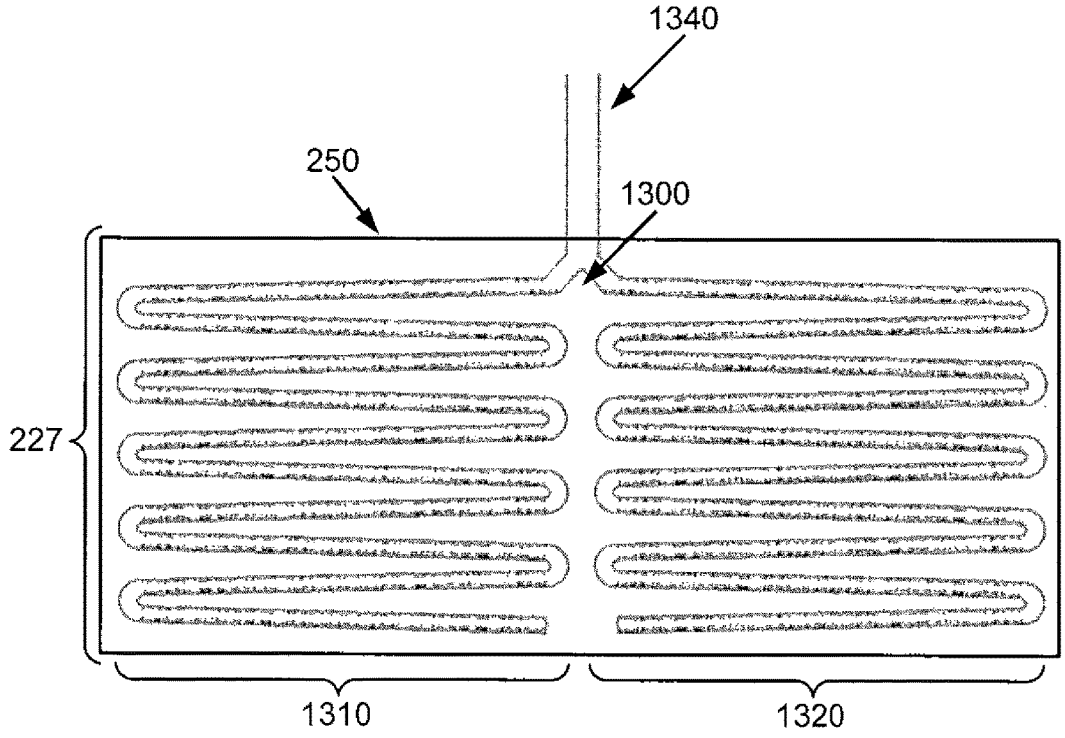
FIG. 13 is a schematic of a wall of a storage region of a refrigeration device.

FIG. 13 illustrates a wall 250 of a storage region within a refrigeration device and the evaporative end 227 of a unidirectional thermal conductor. For purposes of illustration, the wall 250 is shown outside of the storage region of the refrigeration device. In some embodiments, a wall such as that depicted in FIG. 13 can be bent or curved within the storage region, however it is depicted as a flat surface for illustration. In some embodiments, a wall of a storage region can be fabricated as a wall with an evaporative end affixed to it in a manner to facilitate thermal transfer between the wall and the evaporative end of a unidirectional thermal conductor. Some embodiments include an evaporative end in direct thermal contact with at least three walls of the one or more walls substantially forming a storage region. For example, an evaporative end can include a tubular structure fabricated from a thermally-conductive metal affixed to a wall fabricated from a thermally-conductive metal. For example, a wall and/or a tubular structure can be fabricated from aluminum or copper. In some embodiments, an evaporative end can be integrated into a wall of a storage region, for example through roll-bond fabrication methods. A wall of a storage region affixed to an evaporative end can be bent or curved as needed after fabrication to form part of a storage region of a refrigeration device. In some embodiments, a roll-bond fabricated structure is the evaporative end of a unidirectional thermal conductor, and the roll-bond fabricated structure is one or more walls of the storage region. For example, in some embodiments a roll-bond fabricated structure is the evaporative end of a unidirectional thermal conductor, and the roll-bond fabricated structure is bent or curved to form two or more walls of the storage region. For example, in some embodiments a roll-bond fabricated structure is the evaporative end of a unidirectional thermal conductor, and the roll-bond fabricated structure is bent or curved to form at least one shelf within the storage region.

The illustrated evaporative end 227 of the unidirectional thermal conductor shown in FIG. 13 includes tubular structures. The tubular structures include internal evaporative liquid, include a gas pressure less than ambient pressure, and include gas-sealed connections. In some embodiments, the interior of the tubular structures of the evaporative end of the unidirectional thermal conductor can include sintered walls, with an average gap size in the sinter selected relative to the specific evaporative liquid utilized in an embodiment, including its surface tension and vapor pressure. In the embodiment illustrated in FIG. 13, for example, the interior of the tubular structures forming the first region 1310 and the second region 1320 include a sintered surface. See also FIG. 14. In some embodiments, the interior of the tubular structures of the evaporative end of the unidirectional thermal conductor can include porous mesh, such as a metal mesh structure fused to the interior surface of the tubular structures. In embodiments including porous mesh internal to the tubular structures, the pore size of the mesh can be selected relative to the specific evaporative liquid utilized in an embodiment. For example, the pore size can be selected relative to the surface tension of a specific evaporative liquid. In some embodiments, the interior of the tubular structures of the evaporative end of the unidirectional thermal conductor can include grooved or textured interior surfaces, with the grooves or texture spaces selected relative to the specific evaporative liquid utilized in an embodiment.

FIG. 13 depicts a wall 250 of a storage region within a refrigeration device and the evaporative end 227 of a unidirectional thermal conductor, wherein the unidirectional thermal conductor includes a central structure 1340. The central structure 1340 attaches to the evaporative end 227 of the unidirectional thermal conductor. In some embodiments, a central structure can include, for example, an adiabatic region of the unidirectional thermal conductor. In some embodiments, a central structure can include, for example, a condensing end of the unidirectional thermal conductor. Below the central structure 1340, the evaporative end 227 of the unidirectional thermal conductor includes a branched structure 1300. The branched structure illustrated shows a branch point that divides the tubular structure into two branches. In some embodiments, a branch point can divide a structure into three branches. In some embodiments, a branch point can divide a structure into four branches. In some embodiments, a branch point can divide a structure into five branches. In some embodiments, a branch point can divide a structure into six branches. In some embodiments, a branch point can divide a structure into a plurality of branches.

In some embodiments, the evaporative end of a unidirectional thermal conductor can be branched into at least two structural regions, each region including evaporative liquid. For example, in the embodiment illustrated in FIG. 13, the evaporative end 227 includes a first region 1310 and a second region 1320. During use, evaporative liquid can flow down through the central region 1340 to the branch point 1300 and into each of the first region 1310 and the second region 1320. In some embodiments, each of the structural regions of an evaporative end are distinct and not linked, so that no evaporative liquid can flow directly between the regions without passing though the branch point. In some embodiments, the structural regions of an evaporative end are joined at a position near the lowest part of the structural regions, forming a connecting structure through which evaporative liquid can flow between the regions.

In some embodiments, an evaporative end includes a hollow interior and an evaporative liquid within the hollow interior, and wherein the evaporative end includes a series of angled linear segments each including a higher end and a lower end. Some embodiments include wherein the displacement around the circumference of an internal surface within the evaporative end is within a pressure head of the evaporative liquid. Some embodiments include wherein the vertical displacement between each higher end and each lower end is within a pressure head of the evaporative liquid. For example, the embodiment illustrated in FIG. 13 includes a branch point 1300 leading to tubular structures in a first region 1310 and a second region 1320. The angle of each of the linear segments in each of the regions is such that the upper end of each of the segments is within the pressure head of the specific evaporative liquid used in the embodiment. The angle of each of the linear segments is selected based on the physical properties of the evaporative liquid intended for use within that structure, including the surface tension of that evaporative liquid.

Some embodiments include a looped system including at least one vapor-sealed and fluid-sealed conduit containing an evaporative liquid, the conduit in thermal contact with both the liquid-impermeable container and one or more thermally-conductive regions within the storage region, the conduit including an electrically-powered pump for the evaporative liquid. The conduit pump can be, for example, configured to respond to signals from a controller. The controller can, for example, be configured to send signals to the pump to operate when sufficient power is available to the refrigeration device. The controller can, for example, be configured to send signals to the pump to operate after a door to the storage region has been opened. In embodiments wherein the evaporative end of the unidirectional thermal conductor includes a roll-bond fabricated structure, a section of the conduit can be integrated with the roll-bond fabricated structure. For example, a section of the conduit can be integrated with the roll-bond fabricated structure at an edge region of the roll-bond fabricated structure, encircling the hollow tubular structures within the roll-bond fabricated structure included in the evaporative end of the unidirectional thermal conductor.

Figure 14:
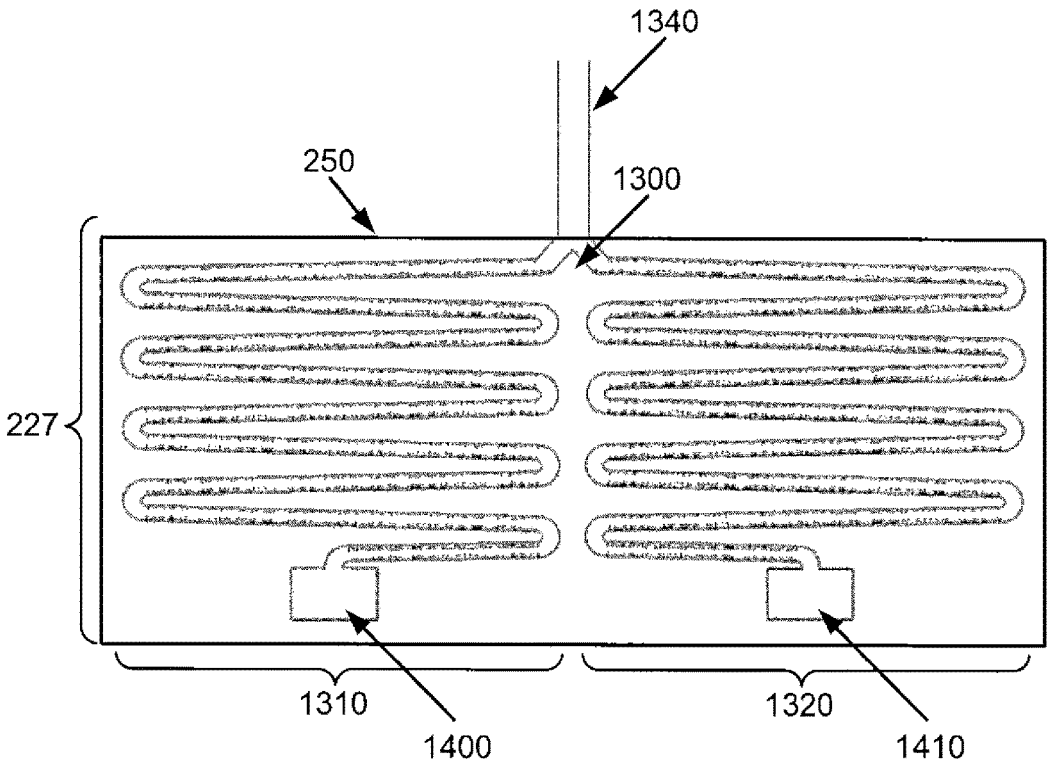
FIG. 14 is a schematic of a wall of a storage region of a refrigeration device.

FIG. 14 illustrates a wall 250 of a storage region within a refrigeration device and the evaporative end 227 of a unidirectional thermal conductor, wherein the unidirectional thermal conductor includes a central structure 1340. The central structure 1340 attaches to the evaporative end 227 of the unidirectional thermal conductor. In the embodiment illustrated in FIG. 13, the evaporative end 227 includes a first region 1310 and a second region 1320. During use, evaporative liquid can flow down through the central region 1340 to the branch point 1300 and into each of the first region 1310 and the second region 1320. Some embodiments include an evaporative end branched into at least two structural regions, each region including reservoir structures configured to hold evaporative liquid. FIG. 14 illustrates an embodiment including a first region 1310 which includes at the lowest point of the region a first reservoir structure 1400 which is configured to hold evaporative liquid. For example, during use, evaporative liquid can flow down through the tubular structures of the central region 1340 to the branch point 1300 and into the first region 1310. The evaporative liquid can then further flow down through the tubular structures of the first region 1310, to end at the lowest point of the first region 1310, within the first reservoir structure 1400. During use, the evaporative liquid can then wick from the first reservoir structure 1400 up through the first region 1310 as part of the normal operation of the unidirectional thermal conductor. Similarly, FIG. 14 illustrates an embodiment including a second region 1320 which includes at the lowest point of the region a second reservoir structure 1410 which is configured to hold evaporative liquid. In some embodiments, one or more reservoir structures are approximately as wide as the entire structural region of the evaporative end to which it is attached. In some embodiments, one or more reservoir structures are approximately 90% of the width of the evaporative end. In some embodiments, one or more reservoir structures are approximately 80% of the width of the evaporative end. In some embodiments, one or more reservoir structures are approximately 70% of the width of the evaporative end.

Figure 15:
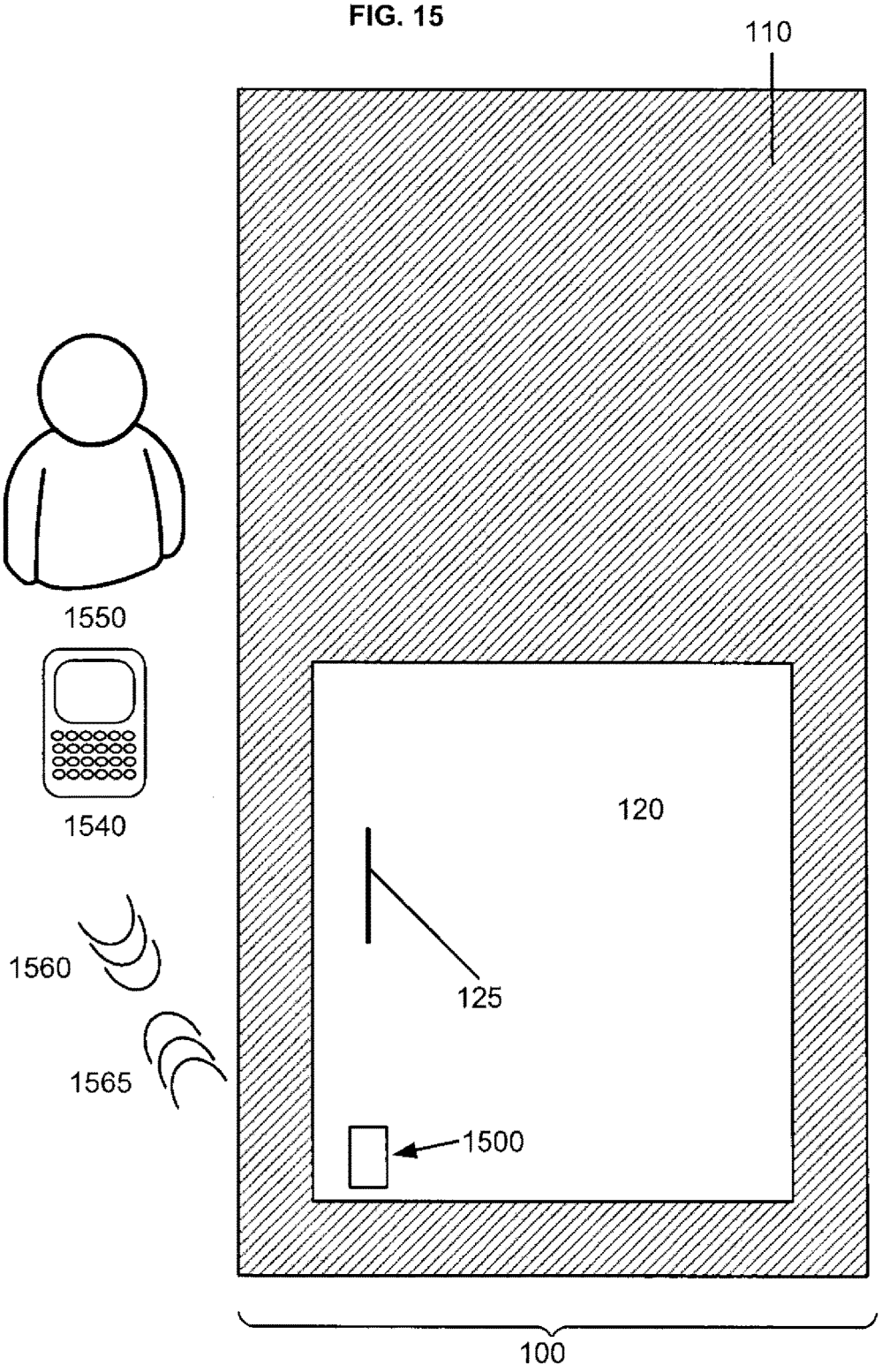
FIG. 15 is a schematic of a refrigeration device and communication system.

FIG. 15 illustrates a refrigeration device 100 that includes a communication system. The refrigeration device 100 is depicted with the front face of an exterior wall 110 visible. The refrigeration device 100 includes a door 120 with a handle 125 configured for a user to access an interior storage region of the refrigeration device 100. The refrigeration device 100 includes a transmitter 1500. In the embodiment illustrated, the transmitter 1500 is affixed to the exterior of the refrigeration device 100 and is visible. In some embodiments, a transmitter can be positioned under a cover or within an interior structure of a refrigeration device. A transmitter can be connected to a controller. A transmitter can be connected to one or more sensors, and configured to send signals in response to data from the one or more sensors. In some embodiments, a transmitter is a cellular phone transmitter. In some embodiments, a transmitter is a Bluetooth® transmitter. In some embodiments, a controller is an Arduino unit.

FIG. 15 depicts that the transmitter sends signals 1565 to a remote device 1540 that can be operated by a user 1550. A remote device can, for example, include a cellular phone, a PDA, or a laptop. A remote device can, for example, include a dedicated device. The remote device can, for example, include circuitry configured to initiate a user interface in response to a signal received from the transmitter. The remote device can, for example, include circuitry configured to store in memory data from a signal received from the transmitter. In the embodiment illustrated, the transmitter 1500 includes a receiver that is configured to receive signals 1560 from the remote device 1540. In some embodiments, a receiver can be connected to a controller that is configured to initiate another part of the refrigeration device in response to a received signal from a remote device. For example, receiver can be connected to a controller that is configured to send a signal to a active refrigeration system, the signal of a type to start or stop the active refrigeration system, in response to a received signal from a remote device.

Although user 1550 is shown/described herein as a single illustrated figure, those skilled in the art will appreciate that user 1550 may be representative of a human user, a robotic user (e.g., computational entity), and/or substantially any combination thereof (e.g., a user may be assisted by one or more robotic agents) unless context dictates otherwise. Those skilled in the art will appreciate that, in general, the same may be said of "sender" and/or other entity-oriented terms as such terms are used herein unless context dictates otherwise.

Figure 16:
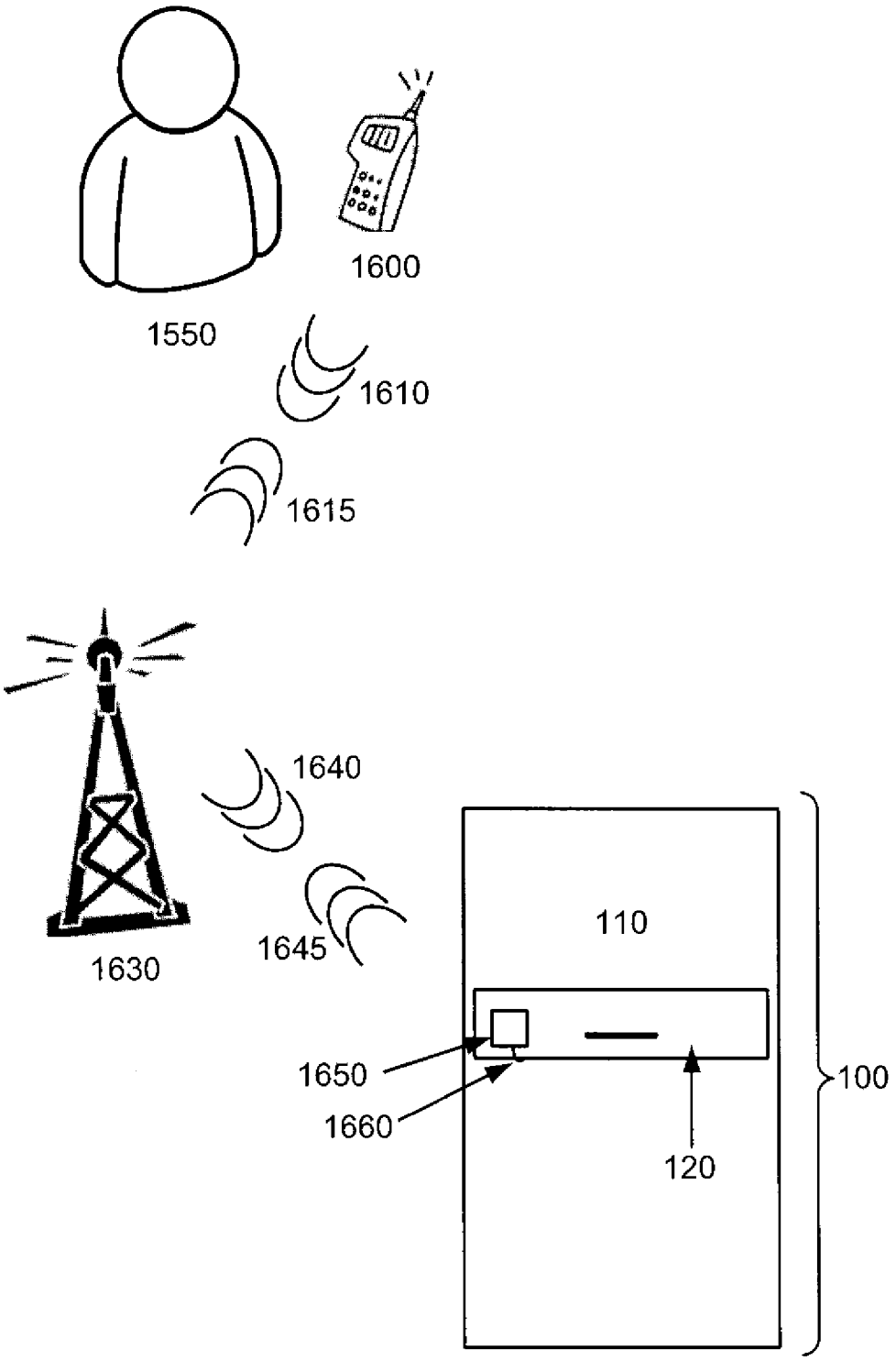
FIG. 16 is a schematic of a refrigeration device and communication system.

FIG. 16 illustrates an embodiment of a refrigeration device 100. The refrigeration device 100 is shown with a front face of an exterior wall 110 visible. The refrigeration device 100 has an attached communication unit 1650. A communication unit can include, for example, a transmitter and a receiver. A communication unit can include, for example, a visible display, such as an LED based display. In some embodiments, for example, a communication unit includes an LED display configured to depict the temperature reading from one or more temperature sensors positioned within the storage region of the refrigeration device. In some embodiments, for example, a communication unit includes an LED display configured to depict access data for the refrigeration device, such as the time interval since the last time that the door of the refrigeration device was opened. In some embodiments, for example, a communication unit includes an LED display configured to depict inventory data regarding the contents of the storage region of the refrigeration device.

In the embodiment illustrated in FIG. 16, the communication unit 1650 is connected to one or more components interior to the door 120 with a wire connector 1660. The communication unit 1650 is operably attached to one or more sensors within the storage region of the refrigeration device 100. For example, in some embodiments, a communication unit 1650 is operably connected to one of more of: a temperature sensor, a data logger, an inventory control device, or a plurality thereof. In the embodiment shown in FIG. 16, the communication unit 1650 is connected to one or more sensors with a wire connector 1660. The communication unit 1650 includes one or more of: a transmitter, a receiver, memory, and a user interface. In some embodiments, the communication unit 1650 includes a transmitter and receiver of cellular signals.

The embodiment illustrated in FIG. 16 depicts signals 1645 transmitted from the communication unit 1650. Signals 1645 can be sent, for example, from the communication unit 1650 to a cellular tower 1630. The cellular tower 1630 can, subsequently, transmit signals 1615 to a cellular device 1600 operated by a user 1550. The cellular device 1600 can include a cell phone connected to a wireless cellular network. The user 1550 can operate the cellular device 1600, causing it to send signals 1610 to a cellular tower 1630 and to the cellular network. A cellular tower 1630 can transmit signals 1640 to a communications unit 1650. For example, the signals can include a status query signal, or a control signal for the refrigeration device 100.

In some embodiments, a refrigeration device includes a communication unit configured to transmit a signal in response to a predetermined condition, for example as detected by a sensor attached to the refrigeration device. For example, in some embodiments a communication unit can be configured to transmit a signal in response to a sensed temperature within a storage region of the refrigeration device. For example, in some embodiments a communication unit can be configured to transmit a signal in response to an elapsed time period, such as after 24 hours has elapsed. For example, in some embodiments a communication unit can be configured to transmit a signal in response to resumption of electrical power in the refrigeration device. In some embodiments, a communication unit includes a power-saving setting for use when minimal power is available. In some embodiments, a communication unit includes a visible indicator, such as a LED. In some embodiments, a communication unit includes a camera configured to capture images when the door of the refrigeration device is opened.

In some implementations described herein, logic and similar implementations may include computer programs or other control structures. Electronic circuitry, for example, may have one or more paths of electrical current constructed and arranged to implement various functions as described herein. In some implementations, one or more media may be configured to bear a device-detectable implementation when such media hold or transmit device detectable instructions operable to perform as described herein. In some variants, for example, implementations may include an update or modification of existing software or firmware, or of gate arrays or programmable hardware, such as by performing a reception of or a transmission of one or more instructions in relation to one or more operations described herein. Alternatively or additionally, in some variants, an implementation may include special-purpose hardware, software, firmware components, and/or general-purpose components executing or otherwise invoking special-purpose components. Specifications or other implementations may be transmitted by one or more instances of tangible transmission media as described herein, optionally by packet transmission or otherwise by passing through distributed media at various times.

In some implementations described herein, logic and similar implementations may be integrated into multiple formats. For example, implementations may include redundancies in hardware, firmware and/or software. For example, implementations may include redundant circuitry systems, such as systems configured to operate in parallel with each other. For example, implementations may include redundant circuitry systems, such as systems configured so that one section of the circuitry is configured to operate when another section of the circuitry is not operational. One set of circuitry can, for example, be configured to operate when ample power is available to the refrigeration device and a second set can be configured to operate when minimal or no external power is available. Some embodiments can include redundant components, such as sensors, controllers, memory units, and transmission units. Some embodiments can include redundant components, such as a redundant electrical panel configured to operate in the event of the failure of the primary electrical panel.

Alternatively or additionally, implementations may include executing a special-purpose instruction sequence or invoking circuitry for enabling, triggering, coordinating, requesting, or otherwise causing one or more occurrences of virtually any functional operation described herein. In some variants, operational or other logical descriptions herein may be expressed as source code and compiled or otherwise invoked as an executable instruction sequence. In some contexts, for example, implementations may be provided, in whole or in part, by source code, such as C++, or other code sequences. In other implementations, source or other code implementation, using commercially available and/or techniques in the art, may be compiled//implemented/translated/converted into a high-level descriptor language (e.g., initially implementing described technologies in C or C++ programming language and thereafter converting the programming language implementation into a logic-synthesizable language implementation, a hardware description language implementation, a hardware design simulation implementation, and/or other such similar mode(s) of expression). For example, some or all of a logical expression (e.g., computer programming language implementation) may be manifested as a Verilog-type hardware description (e.g., via Hardware Description Language (HDL) and/or Very High Speed Integrated Circuit Hardware Descriptor Language (VHDL)) or other circuitry model which may then be used to create a physical implementation having hardware (e.g., an Application Specific Integrated Circuit). Those skilled in the art will recognize how to obtain, configure, and optimize suitable transmission or computational elements, material supplies, actuators, or other structures in light of these teachings.

In an embodiment, several portions of the subject matter described herein may be implemented via Application Specific Integrated Circuits (ASICs), Field Programmable Gate Arrays (FPGAs), digital signal processors (DSPs), or other integrated formats. However, some aspects of the embodiments disclosed herein, in whole or in part, can be equivalently implemented in integrated circuits, as one or more computer programs running on one or more computers (e.g., as one or more programs running on one or more computer systems), as one or more programs running on one or more processors (e.g., as one or more programs running on one or more microprocessors), as firmware, or as virtually any combination thereof, and that designing the circuitry and/or writing the code for the software and or firmware would be well within the skill of one of skill in the art in light of this disclosure. In addition, aspects of the subject matter described herein are capable of being distributed as a program product in a variety of forms, and that an illustrative embodiment of the subject matter described herein applies regardless of the particular type of signal bearing medium used to actually carry out the distribution. Examples of a signal bearing medium include, but are not limited to, the following: a recordable type medium such as a floppy disk, a hard disk drive, a Compact Disc (CD), a Digital Video Disk (DVD), a digital tape, a computer memory, etc.; and a transmission type medium such as a digital and/or an analog communication medium (e.g., a fiber optic cable, a waveguide, a wired communications link, a wireless communication link (e.g., transmitter, receiver, transmission logic, reception logic, etc.), etc.).

In a general sense, the various embodiments described herein can be implemented, individually and/or collectively, by various types of electro-mechanical systems having a wide range of electrical components such as hardware, software, firmware, and/or virtually any combination thereof; and a wide range of components that may impart mechanical force or motion such as rigid bodies, spring or torsional bodies, hydraulics, electro-magnetically actuated devices, and/or virtually any combination thereof. Consequently, as used herein "electro-mechanical system" includes, but is not limited to, electrical circuitry operably coupled with a transducer (e.g., an actuator, a motor, a piezoelectric crystal, a Micro Electro Mechanical System (MEMS), etc.), electrical circuitry having at least one discrete electrical circuit, electrical circuitry having at least one integrated circuit, electrical circuitry having at least one application specific integrated circuit, electrical circuitry forming a general purpose computing device configured by a computer program (e.g., a general purpose computer configured by a computer program which at least partially carries out processes and/or devices described herein, or a microprocessor configured by a computer program which at least partially carries out processes and/or devices described herein), electrical circuitry forming a memory device (e.g., forms of memory (e.g., random access, flash, read only, etc.)), electrical circuitry forming a communications device (e.g., a modem, communications switch, optical-electrical equipment, etc.), and/or any non-electrical analog thereto, such as optical or other analogs (e.g., graphene based circuitry). Examples of electro-mechanical systems include but are not limited to a variety of consumer electronics systems, medical devices, as well as other systems such as motorized transport systems, factory automation systems, security systems, and/or communication/computing systems. Electro-mechanical as used herein is not necessarily limited to a system that has both electrical and mechanical actuation except as context may dictate otherwise.

In a general sense, the various aspects described herein which can be implemented, individually and/or collectively, by a wide range of hardware, software, firmware, and/or any combination thereof can be viewed as being composed of various types of "electrical circuitry." Consequently, as used herein "electrical circuitry" includes, but is not limited to, electrical circuitry having at least one discrete electrical circuit, electrical circuitry having at least one integrated circuit, electrical circuitry having at least one application specific integrated circuit, electrical circuitry forming a general purpose computing device configured by a computer program (e.g., a general purpose computer configured by a computer program which at least partially carries out processes and/or devices described herein, or a microprocessor configured by a computer program which at least partially carries out processes and/or devices described herein), electrical circuitry forming a memory device (e.g., forms of memory (e.g., random access, flash, read only, etc.)), and/or electrical circuitry forming a communications device (e.g., a modem, communications switch, optical-electrical equipment, etc.). The subject matter described herein may be implemented in an analog or digital fashion or some combination thereof.

At least a portion of the devices and/or processes described herein can be integrated into an image processing system. A typical image processing system generally includes one or more of a system unit housing, a video display device, memory such as volatile or non-volatile memory, processors such as microprocessors or digital signal processors, computational entities such as operating systems, drivers, applications programs, one or more interaction devices (e.g., a touch pad, a touch screen, an antenna, etc.), control systems including feedback loops and control motors (e.g., feedback for sensing lens position and/or velocity; control motors for moving/distorting lenses to give desired focuses). An image processing system may be implemented utilizing suitable commercially available components, such as those typically found in digital still systems and/or digital motion systems.

At least a portion of the devices and/or processes described herein can be integrated into a data processing system. A data processing system generally includes one or more of a system unit housing, a video display device, memory such as volatile or non-volatile memory, processors such as microprocessors or digital signal processors, computational entities such as operating systems, drivers, graphical user interfaces, and applications programs, one or more interaction devices (e.g., a touch pad, a touch screen, an antenna, etc.), and/or control systems including feedback loops and control motors (e.g., feedback for sensing position and/or velocity; control motors for moving and/or adjusting components and/or quantities). A data processing system may be implemented utilizing suitable commercially available components, such as those typically found in data computing/communication and/or network computing/communication systems.

The herein described components (e.g., operations), devices, objects, and the discussion accompanying them are used as examples for the sake of conceptual clarity and that various configuration modifications are contemplated. Consequently, as used herein, the specific exemplars set forth and the accompanying discussion are intended to be representative of their more general classes. In general, use of any specific exemplar is intended to be representative of its class, and the non-inclusion of specific components (e.g., operations), devices, and objects should not be taken limiting.

The herein described subject matter sometimes illustrates different components contained within, or connected with, different other components. It is to be understood that such depicted architectures are merely exemplary, and that in fact many other architectures may be implemented which achieve the same functionality. In a conceptual sense, any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermedial components. Likewise, any two components so associated can also be viewed as being "operably connected", or "operably coupled," to each other to achieve the desired functionality, and any two components capable of being so associated can also be viewed as being "operably couplable," to each other to achieve the desired functionality. Specific examples of operably couplable include but are not limited to physically mateable and/or physically interacting components, and/or wirelessly interactable, and/or wirelessly interacting components, and/or logically interacting, and/or logically interactable components.

In some instances, one or more components may be referred to herein as "configured to," "configured by," "configurable to," "operable/operative to," "adapted/adaptable," "able to," "conformable/conformed to," etc. Such terms (e.g. "configured to") generally encompass active-state components and/or inactive-state components and/or standby-state components, unless context requires otherwise.

For the purposes of this application, "cloud" computing may be understood as described in the cloud computing literature. For example, cloud computing may be methods and/or systems for the delivery of computational capacity and/or storage capacity as a service. The "cloud" may refer to one or more hardware and/or software components that deliver or assist in the delivery of computational and/or storage capacity, including, but not limited to, one or more of a client, an application, a platform, an infrastructure, and/or a server. The cloud may refer to any of the hardware and/or software associated with a client, an application, a platform, an infrastructure, and/or a server. For example, cloud and cloud computing may refer to one or more of a computer, a processor, a storage medium, a router, a switch, a modem, a virtual machine (e.g., a virtual server), a data center, an operating system, a middleware, a firmware, a hardware back-end, a software back-end, and/or a software application. A cloud may refer to a private cloud, a public cloud, a hybrid cloud, and/or a community cloud. A cloud may be a shared pool of configurable computing resources, which may be public, private, semi-private, distributable, scaleable, flexible, temporary, virtual, and/or physical. A cloud or cloud service may be delivered over one or more types of network, e.g., a mobile communication network, and the Internet.

As used in this application, a cloud or a cloud service may include one or more of infrastructure-as-a-service ("IaaS"), platform-as-a-service ("PaaS"), software-as-a-service ("SaaS"), and/or desktop-as-a-service ("DaaS"). As a non-exclusive example, IaaS may include, e.g., one or more virtual server instantiations that may start, stop, access, and/or configure virtual servers and/or storage centers (e.g., providing one or more processors, storage space, and/or network resources on-demand, e.g., EMC and Rackspace).

PaaS may include, e.g., one or more software and/or development tools hosted on an infrastructure (e.g., a computing platform and/or a solution stack from which the client can create software interfaces and applications, e.g., Microsoft Azure). SaaS may include, e.g., software hosted by a service provider and accessible over a network (e.g., the software for the application and/or the data associated with that software application may be kept on the network, e.g., Google Apps, SalesForce). DaaS may include, e.g., providing desktop, applications, data, and/or services for the user over a network (e.g., providing a multi-application framework, the applications in the framework, the data associated with the applications, and/or services related to the applications and/or the data over the network, e.g., Citrix). The foregoing is intended to be exemplary of the types of systems and/or methods referred to in this application as "cloud" or "cloud computing" and should not be considered complete or exhaustive.

While particular aspects of the present subject matter described herein have been shown and described, it will be apparent that, based upon the teachings herein, changes and modifications may be made without departing from the subject matter described herein and its broader aspects and, therefore, the appended claims are to encompass within their scope all such changes and modifications as are within the true spirit and scope of the subject matter described herein. In general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). It will be further understood that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to claims containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations. In addition, even if a specific number of an introduced claim recitation is explicitly recited, such recitation should typically be interpreted to mean at least the recited number (e.g., the bare recitation of "two recitations," without other modifiers, typically means at least two recitations, or two or more recitations). Furthermore, in those instances where a convention analogous to "at least one of A, B, and C, etc." is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.). In those instances where a convention analogous to "at least one of A, B, or C, etc." is used, in general such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, etc.). It will be further understood that typically a disjunctive word and/or phrase presenting two or more alternative terms, whether in the description, claims, or drawings, should be understood to contemplate the possibilities of including one of the terms, either of the terms, or both terms unless context dictates otherwise. For example, the phrase "A or B" will be typically understood to include the possibilities of "A" or "B" or "A and B."

With respect to the appended claims, those skilled in the art will appreciate that recited operations therein may generally be performed in any order. Also, although various operational flows are presented in a sequence(s), it should be understood that the various operations may be performed in other orders than those which are illustrated, or may be performed concurrently. Examples of such alternate orderings may include overlapping, interleaved, interrupted, reordered, incremental, preparatory, supplemental, simultaneous, reverse, or other variant orderings, unless context dictates otherwise. Furthermore, terms like "responsive to," "related to," or other past-tense adjectives are generally not intended to exclude such variants, unless context dictates otherwise.

Aspects of the subject matter described herein are set out in the following numbered clauses:

1. A refrigeration device can include: one or more walls substantially forming a liquid-impermeable container, the container configured to hold phase change material internal to the refrigeration device; at least one active refrigeration unit including a set of evaporator coils, the evaporator coils positioned at least partially within the liquid-impermeable container; a unidirectional thermal conductor with a condensing end and an evaporative end, the condensing end positioned within the liquid-impermeable container; a first aperture in the liquid-impermeable container, the first aperture of a size, shape and position to permit the at least one set of evaporator coils to traverse the aperture; a second aperture in the liquid-impermeable container, the second aperture including an internal surface of a size, shape and position to mate with an external surface of the unidirectional thermal conductor; and one or more walls substantially forming a storage region, at least one of the one or more walls in thermal contact with the evaporative end of the unidirectional thermal conductor.
2. The refrigeration device of paragraph 1, wherein the liquid-impermeable container includes an access lid within a top surface of the liquid-impermeable container, the access lid configured for a user to access an interior of the liquid-impermeable container.
3. The refrigeration device of paragraph 1, wherein the liquid-impermeable container includes a phase-change material positioned within the liquid-impermeable container.
4. The refrigeration device of paragraph 1, wherein the liquid-impermeable container is positioned above the storage region in the refrigeration device.
5. The refrigeration device of paragraph 1, wherein the at least one active refrigeration unit includes a refrigeration active refrigeration system.
6. The refrigeration device of paragraph 1, wherein the unidirectional thermal conductor includes a thermosyphon.
7. The refrigeration device of paragraph 1, wherein the unidirectional thermal conductor includes a heat pipe.

8. The refrigeration device of paragraph 1, wherein the unidirectional thermal conductor includes a tubular structure with a substantially sealed internal region, and an evaporative liquid sealed within the substantially sealed internal region.
9. The refrigeration device of paragraph 1, wherein the unidirectional thermal conductor includes a structure including an adiabatic region positioned between the condensing end and the evaporative end, the adiabatic region positioned between the liquid-impermeable container and the storage region.
10. The refrigeration device of paragraph 1, wherein the unidirectional thermal conductor includes an evaporative end branched into at least two structural regions, each region including evaporative liquid.
11. The refrigeration device of paragraph 1, wherein the unidirectional thermal conductor includes an evaporative end branched into at least two structural regions, each region including reservoir structures configured to hold evaporative liquid.
12. The refrigeration device of paragraph 1, wherein the unidirectional thermal conductor includes a hollow interior and an evaporative liquid within the hollow interior, and wherein the evaporative end includes a series of angled linear segments each including a higher end and a lower end, wherein the vertical displacement between each higher end and each lower end is within a pressure head of the evaporative liquid.
13. The refrigeration device of paragraph 1, wherein the unidirectional thermal conductor includes an evaporative end in direct thermal contact with at least three walls of the one or more walls substantially forming a storage region.
14. The refrigeration device of paragraph 1, wherein the unidirectional thermal conductor includes an evaporative end positioned at an angle less than 90 degrees relative to a lower wall of the storage region.
15. The refrigeration device of paragraph 1, wherein the evaporative end of the thermal conductor includes a branched structure.
16. The refrigeration device of paragraph 1, wherein the condensing end of the thermal conductor includes a branched structure.
17. The refrigeration device of paragraph 1, wherein the first aperture in the liquid-impermeable container is positioned substantially within a top surface of the liquid-impermeable container.
18. The refrigeration device of paragraph 1, wherein the first aperture in the liquid-impermeable container includes a liquid-impermeable seal positioned between the liquid-impermeable container and the at least one set of evaporator coils traversing the aperture.
19. The refrigeration device of paragraph 1, wherein the second aperture in the liquid-impermeable container is positioned substantially within a lower surface of the liquid-impermeable container.
20. The refrigeration device of paragraph 1, wherein the second aperture in the liquid-impermeable container includes a liquid-impermeable seal positioned between the liquid-impermeable container and the external surface of the thermal conductor traversing the aperture.
21. The refrigeration device of paragraph 1, wherein the one or more walls substantially forming a storage region includes one or more walls fabricated from a thermally conductive material, at least one of the one or more walls affixed to the evaporative end of the thermal conductor.
22. The refrigeration device of paragraph 1, wherein the one or more walls substantially forming a storage region includes a reversibly-closable door positioned and configured to provide access to the storage region for a user of the refrigeration device.
23. The refrigeration device of paragraph 1, including a shell forming an exterior of the refrigeration device around the liquid-impermeable container, the at least one set of evaporator coils, the thermal conductor and the storage region.
24. The refrigeration device of paragraph 1, including insulation positioned adjacent to an exterior surface of the storage region.
25. The refrigeration device of paragraph 1, including insulation positioned adjacent to an exterior surface of the liquid-impermeable container.
26. The refrigeration device of paragraph 1, including a variable power control system attached to the at least one active refrigeration unit.
27. The refrigeration device of paragraph 1, including a battery affixed to the at least one active refrigeration unit.
28. The refrigeration device of paragraph 1, including a temperature sensor positioned within the liquid-impermeable container, the temperature sensor connected to the active refrigeration unit.
29. The refrigeration device of paragraph 1, including a temperature sensor positioned within the storage region, the temperature sensor connected to the active refrigeration unit.
30. The refrigeration device of paragraph 1, including a thermal control device affixed to the unidirectional thermal conductor at a position between the condensing end and the evaporative end.
31. The refrigeration device of paragraph 30, wherein the thermal control device includes a valve affixed to the unidirectional thermal conductor.
32. The refrigeration device of paragraph 30, further including a temperature sensor positioned within the storage region, the temperature sensor connected to the thermal control device.
33. The refrigeration device of paragraph 1, including a door affixed to the storage region, the door positioned and configured to permit a user to access the storage region with minimal heat leakage from the door.
34. The refrigeration device of paragraph 1, including one or more walls substantially forming a second storage region, a second unidirectional thermal conductor with a condensing end and an evaporative end, the condensing end positioned within the liquid-impermeable container and the evaporative end positioned in thermal contact with the second storage region, and a third aperture in the liquid-impermeable container, the third aperture including an internal surface of a size, shape and position to mate with an external surface of the second unidirectional thermal conductor.
35. The refrigeration device of paragraph 1, including one or more walls substantially forming a second liquid-impermeable container, the second liquid-impermeable container configured to hold phase change material internal to the refrigeration device, a second set of evaporator coils affixed to the at least one active refrigeration unit, the second set of evaporator coils positioned at least partially within the second liquid-impermeable container, a second unidirectional thermal conductor with a condensing end and an evaporative end, the condensing end positioned within the second liquid-impermeable container and the evaporative end positioned in thermal contact with the second storage region and one or more walls substantially forming a second storage region, at least one of the one or more walls in thermal contact with the second unidirectional thermal conductor.

36. The refrigeration device of paragraph 1, including one or more walls substantially forming a second liquid-impermeable container, the container configured to hold phase change material internal to the refrigeration device, a second active refrigeration system including at least one second set of evaporator coils, the second set of evaporator coils positioned at least partially within the second liquid-impermeable container, and one or more walls substantially forming a second storage region, at least one of the one or more walls in thermal contact with the second liquid-impermeable container.

37. The refrigeration device of paragraph 1, including one or more sensors attached to the refrigeration device, and a transmitter attached to the one or more sensors.

38. In some embodiments, a refrigeration device includes: one or more walls substantially forming a first liquid-impermeable container, the container configured to hold phase change material internal to the refrigeration device; a first active refrigeration system including at least one first set of evaporator coils, the first set of evaporator coils positioned at least partially within the first liquid-impermeable container; a first aperture in the liquid-impermeable container, the first aperture of a size, shape and position to permit the at least one first set of evaporator coils to traverse the aperture; a unidirectional thermal conductor with a condensing end and an evaporative end, the condensing end positioned within the liquid-impermeable container; a second aperture in the liquid-impermeable container, the second aperture including an internal surface of a size, shape and position to mate with an external surface of the unidirectional thermal conductor; one or more walls substantially forming a first storage region, at least one of the one or more walls in thermal contact with the evaporative end of the unidirectional thermal conductor; one or more walls substantially forming a second liquid-impermeable container, the container configured to hold phase change material internal to the refrigeration device; a second active refrigeration system including at least one second set of evaporator coils, the second set of evaporator coils positioned at least partially within the second liquid-impermeable container; and one or more walls substantially forming a second storage region, at least one of the one or more walls in thermal contact with the second liquid-impermeable container.

39. The refrigeration device of paragraph 38, wherein the liquid-impermeable container includes an access lid within a top surface of the liquid-impermeable container, the access lid configured for a user to access an interior of the liquid-impermeable container.

40. The refrigeration device of paragraph 38, wherein the liquid-impermeable container includes a phase-change material positioned within the liquid-impermeable container.

41. The refrigeration device of paragraph 38, wherein the liquid-impermeable container is positioned above the storage region in the refrigeration device.

42. The refrigeration device of paragraph 38, wherein the active refrigeration system includes an electrically-powered refrigeration active refrigeration system.

43. The refrigeration device of paragraph 38, wherein the first aperture in the liquid-impermeable container is positioned substantially within a top surface of the liquid-impermeable container.

44. The refrigeration device of paragraph 38, wherein the first aperture in the liquid-impermeable container includes a liquid-impermeable seal positioned between the liquid-impermeable container and the at least one set of evaporator coils traversing the aperture.

45. The refrigeration device of paragraph 38, wherein the unidirectional thermal conductor includes a thermosyphon.

46. The refrigeration device of paragraph 38, wherein the unidirectional thermal conductor includes a heat pipe.

47. The refrigeration device of paragraph 38, wherein the unidirectional thermal conductor includes a tubular structure with a substantially sealed internal region, and an evaporative fluid sealed within the substantially sealed internal region.

48. The refrigeration device of paragraph 38, wherein the unidirectional thermal conductor includes a structure including an adiabatic region positioned between the condensing end and the evaporative end, the adiabatic region positioned between the liquid-impermeable container and the storage region.

49. The refrigeration device of paragraph 38, wherein the unidirectional thermal conductor includes an evaporative end branched into at least two structural regions, each region including evaporative liquid.

50. The refrigeration device of paragraph 38, wherein the unidirectional thermal conductor includes an evaporative end branched into at least two structural regions, each region including reservoir structures configured to hold evaporative liquid.

51. The refrigeration device of paragraph 38, wherein the unidirectional thermal conductor includes a hollow interior and an evaporative liquid within the hollow interior, and wherein the evaporative end includes a series of angled linear segments each including a higher end and a lower end, wherein the vertical displacement between each higher end and each lower end is within a pressure head of the evaporative liquid.

52. The refrigeration device of paragraph 38, wherein the unidirectional thermal conductor includes an evaporative end in direct thermal contact with at least three walls of the one or more walls substantially forming a storage region.

53. The refrigeration device of paragraph 38, wherein the unidirectional thermal conductor includes an evaporative end positioned at an angle less than 90 degrees relative to a lower wall of the storage region.

54. The refrigeration device of paragraph 38, wherein the condensing end of the unidirectional thermal conductor includes a branched structure.

55. The refrigeration device of paragraph 38, wherein the evaporative end of the unidirectional thermal conductor includes a branched structure.

56. The refrigeration device of paragraph 38, wherein the second aperture in the liquid-impermeable container is positioned substantially within a lower surface of the liquid-impermeable container.

57. The refrigeration device of paragraph 38, wherein the second aperture in the liquid-impermeable container includes a liquid-impermeable seal positioned between the liquid-impermeable container and the external surface of the thermal conductor traversing the aperture.

58. The refrigeration device of paragraph 38, wherein the one or more walls substantially forming a storage region includes one or more walls fabricated from a thermally conductive material, at least one of the one or more walls affixed to the evaporative end of the thermal conductor.

59. The refrigeration device of paragraph 38, wherein the one or more walls substantially forming a storage region includes a reversibly-closable door positioned and configured to provide access to the storage region for a user of the refrigeration device.
60. The refrigeration device of paragraph 38, wherein the external shell includes a shell forming an exterior of the refrigeration device around the liquid-impermeable container, the at least one set of evaporator coils, the thermal conductor and the storage region.
61. The refrigeration device of paragraph 38, wherein the insulation within the gap includes insulation positioned adjacent to an exterior surface of the storage region.
62. The refrigeration device of paragraph 38, wherein the insulation within the gap includes insulation positioned adjacent to an exterior surface of the liquid-impermeable container.
63. The refrigeration device of paragraph 38, including a variable power control system attached to the first active refrigeration system and to the second active refrigeration system.
64. The refrigeration device of paragraph 38, including a controller operably connected to both the first active refrigeration system and the second active refrigeration system.
65. The refrigeration device of paragraph 38, including a battery affixed to the first active refrigeration system and to the second active refrigeration system.
66. The refrigeration device of paragraph 38, including a temperature sensor positioned within the liquid-impermeable container, the temperature sensor connected to the active refrigeration unit.
67. The refrigeration device of paragraph 38, including a temperature sensor positioned within the storage region, the temperature sensor connected to the active refrigeration unit.
68. The refrigeration device of paragraph 38, including a thermal control device affixed to the unidirectional thermal conductor at a position between the condensing end and the evaporative end.
69. The refrigeration device of paragraph 68, wherein the thermal control device includes a valve affixed to the unidirectional thermal conductor.
70. The refrigeration device of paragraph 38, including a temperature sensor positioned within the storage region, the temperature sensor connected to the thermal control device.
71. The refrigeration device of paragraph 38, including a first door affixed to the external shell adjacent to the first storage region, the first door positioned and configured to permit a user to access the first storage region with minimal heat leakage from the first door.
72. The refrigeration device of paragraph 38, including a second door affixed to the external shell adjacent to the second storage region, the second door positioned and configured to permit a user to access the second storage region with minimal heat leakage from the second door.
73. The refrigeration device of paragraph 38, including: an external shell surrounding internal components including the one or more walls substantially forming the first liquid-impermeable container, the second liquid-impermeable container, the unidirectional thermal conductor, the one or more walls substantially forming a first storage region, and the one or more walls substantially forming a first storage region, with a gap between an inner surface of the external shell and the internal components; and insulation within the gap.
74. The refrigeration device of paragraph 38, including one or more sensors attached to the refrigeration device, and a transmitter attached to the one or more sensors.
75. In some embodiments, a refrigeration device includes: one or more walls substantially forming a liquid-impermeable container, the container configured to hold phase change material internal to the refrigeration device; at least one active refrigeration unit including a set of evaporator coils, the evaporator coils positioned at least partially within the liquid-impermeable container; a unidirectional thermal conductor including a hollow interior and an evaporative liquid within the hollow interior, the unidirectional thermal conductor with a condensing end and an evaporative end, the condensing end positioned within the liquid-impermeable container, the evaporative end including a series of angled linear segments each including a higher end and a lower end, wherein the vertical displacement between each higher end and each lower end is within a pressure head of the evaporative liquid; a first aperture in the liquid-impermeable container, the first aperture of a size, shape and position to permit the at least one set of evaporator coils to traverse the aperture; a second aperture in the liquid-impermeable container, the second aperture including an internal surface of a size, shape and position to mate with an external surface of the thermal conductor; and one or more walls substantially forming a storage region, at least one of the one or more walls in thermal contact with the evaporative end of the thermal conductor.
76. The refrigeration device of paragraph 75, wherein the liquid-impermeable container includes an access lid within a top surface of the liquid-impermeable container, the access lid configured for a user to access an interior of the liquid-impermeable container.
77. The refrigeration device of paragraph 75, wherein the liquid-impermeable container includes a phase-change material positioned within the liquid-impermeable container.
78. The refrigeration device of paragraph 75, wherein the liquid-impermeable container is positioned above the storage region in the refrigeration device.
79. The refrigeration device of paragraph 75, wherein the at least one active refrigeration unit includes a refrigeration active refrigeration system.
80. The refrigeration device of paragraph 75, wherein the unidirectional thermal conductor includes a thermosyphon.
81. The refrigeration device of paragraph 75, wherein the unidirectional thermal conductor includes a heat pipe.
82. The refrigeration device of paragraph 75, wherein the unidirectional thermal conductor includes a tubular structure with a substantially sealed internal region, and an evaporative fluid sealed within the substantially sealed internal region.
83. The refrigeration device of paragraph 75, wherein the unidirectional thermal conductor includes a structure including an adiabatic region positioned between the condensing end and the evaporative end, the adiabatic region positioned between the liquid-impermeable container and the storage region.
84. The refrigeration device of paragraph 75, wherein the condensing end of the unidirectional thermal conductor includes a branched structure.
85. The refrigeration device of paragraph 75, wherein the evaporative end of the unidirectional thermal conductor includes a branched structure.

86. The refrigeration device of paragraph 75, wherein the unidirectional thermal conductor includes an evaporative end branched into at least two structural regions, each region including evaporative liquid.
87. The refrigeration device of paragraph 75, wherein the unidirectional thermal conductor includes an evaporative end branched into at least two structural regions, each region including reservoir structures configured to hold evaporative liquid.
88. The refrigeration device of paragraph 75, wherein the unidirectional thermal conductor includes a hollow interior and an evaporative liquid within the hollow interior, and wherein the evaporative end includes a series of angled linear segments each including a higher end and a lower end, wherein the vertical displacement between each higher end and each lower end is within a pressure head of the evaporative liquid.
89. The refrigeration device of paragraph 75, wherein the unidirectional thermal conductor includes an evaporative end in direct thermal contact with at least three walls of the one or more walls substantially forming a storage region.
90. The refrigeration device of paragraph 75, wherein the unidirectional thermal conductor includes an evaporative end positioned at an angle less than 90 degrees relative to a lower wall of the storage region.
91. The refrigeration device of paragraph 75, wherein the first aperture in the liquid-impermeable container is positioned substantially within a top surface of the liquid-impermeable container.
92. The refrigeration device of paragraph 75, wherein the first aperture in the liquid-impermeable container includes a liquid-impermeable seal positioned between the liquid-impermeable container and the at least one set of evaporator coils traversing the aperture.
93. The refrigeration device of paragraph 75, wherein the second aperture in the liquid-impermeable container is positioned substantially within a lower surface of the liquid-impermeable container.
94. The refrigeration device of paragraph 75, wherein the second aperture in the liquid-impermeable container includes a liquid-impermeable seal positioned between the liquid-impermeable container and the external surface of the thermal conductor traversing the aperture.
95. The refrigeration device of paragraph 75, wherein the one or more walls substantially forming a storage region includes one or more walls fabricated from a thermally conductive material, at least one of the one or more walls affixed to the evaporative end of the thermal conductor.
96. The refrigeration device of paragraph 75, wherein the one or more walls substantially forming a storage region includes a reversibly-closable door positioned and configured to provide access to the storage region for a user of the refrigeration device.
97. The refrigeration device of paragraph 75, including a shell forming an exterior of the refrigeration device around the liquid-impermeable container, the at least one set of evaporator coils, the thermal conductor and the storage region.
98. The refrigeration device of paragraph 75, including insulation positioned adjacent to an exterior surface of the storage region.
99. The refrigeration device of paragraph 75, including insulation positioned adjacent to an exterior surface of the liquid-impermeable container.
100. The refrigeration device of paragraph 75, including a variable power control system attached to the at least one active refrigeration unit.
101. The refrigeration device of paragraph 75, including a battery affixed to the at least one active refrigeration unit.
102. The refrigeration device of paragraph 75, including a temperature sensor positioned within the liquid-impermeable container, the temperature sensor connected to the active refrigeration unit.
103. The refrigeration device of paragraph 75, including a temperature sensor positioned within the storage region, the temperature sensor connected to the active refrigeration unit.
104. The refrigeration device of paragraph 75, including a thermal control device affixed to the unidirectional thermal conductor at a position between the condensing end and the evaporative end.
105. The refrigeration device of paragraph 104, wherein the thermal control device includes a valve affixed to the unidirectional thermal conductor.
106. The refrigeration device of paragraph 104, including a temperature sensor positioned within the storage region, the temperature sensor connected to the thermal control device.
107. The refrigeration device of paragraph 75, including a door affixed to the storage region, the door positioned and configured to permit a user to access the storage region with minimal heat leakage from the door.
108. The refrigeration device of paragraph 75, including: one or more walls substantially forming a second liquid-impermeable container, the container configured to hold phase change material internal to the refrigeration device; a second active refrigeration system including at least one second set of evaporator coils, the second set of evaporator coils positioned at least partially within the second liquid-impermeable container; and one or more walls substantially forming a second storage region, at least one of the one or more walls in thermal contact with the second liquid-impermeable container.
109. The refrigeration device of paragraph 75, including: one or more sensors attached to the refrigeration device; and a transmitter attached to the one or more sensors.

All of the above U.S. patents, U.S. patent application publications, U.S. patent applications, foreign patents, foreign patent applications and non-patent publications referred to in this specification and/or listed in any Application Data Sheet, are incorporated herein by reference, to the extent not inconsistent herewith.

While various aspects and embodiments have been disclosed herein, other aspects and embodiments will be apparent to those skilled in the art. The various aspects and embodiments disclosed herein are for purposes of illustration and are not intended to be limiting, with the true scope and spirit being indicated by the following claims.

What is claimed is:

1. A refrigeration device, comprising:

one or more walls substantially forming a liquid-impermeable container, the container configured to hold phase change material internal to the refrigeration device;

at least one active refrigeration unit including a set of evaporator coils, the evaporator coils positioned at least partially within the liquid-impermeable container;

a unidirectional thermal conductor with a condensing end and an evaporative end, the condensing end positioned within the liquid-impermeable container;

a first aperture in the liquid-impermeable container, the first aperture of a size, shape and position to permit the at least one set of evaporator coils to traverse the aperture;

a second aperture in the liquid-impermeable container, the second aperture including an internal surface of a size, shape and position to mate with an external surface of the unidirectional thermal conductor; and one or more walls substantially forming a storage region, at least one of the one or more walls in thermal contact with the evaporative end of the unidirectional thermal conductor.

2. The refrigeration device of claim 1, wherein the liquid-impermeable container is positioned above the storage region in the refrigeration device.

3. The refrigeration device of claim 1, wherein the unidirectional thermal conductor comprises:

a thermosyphon.

4. The refrigeration device of claim 1, wherein the unidirectional thermal conductor comprises:

a heat pipe.

5. The refrigeration device of claim 1, wherein the evaporative end of the thermal conductor comprises:

a branched structure.

6. The refrigeration device of claim 1, wherein the condensing end of the thermal conductor comprises:

a branched structure.

7. The refrigeration device of claim 1, wherein the one or more walls substantially forming a storage region comprise:

one or more walls fabricated from a thermally conductive material, at least one of the one or more walls affixed to the evaporative end of the thermal conductor.

8. The refrigeration device of claim 1, further comprising:

a variable power control system attached to the at least one active refrigeration unit.

9. The refrigeration device of claim 1, further comprising:

a temperature sensor positioned within the liquid-impermeable container, the temperature sensor connected to the active refrigeration unit.

10. The refrigeration device of claim 1, further comprising:

a temperature sensor positioned within the storage region, the temperature sensor connected to the active refrigeration unit.

11. The refrigeration device of claim 1, further comprising:

a thermal control device affixed to the unidirectional thermal conductor at a position between the condensing end and the evaporative end.

12. The refrigeration device of claim 11, further comprising:

a temperature sensor positioned within the storage region, the temperature sensor connected to the thermal control device.

13. The refrigeration device of claim 1, further comprising:

one or more walls substantially forming a second storage region;

a second unidirectional thermal conductor with a condensing end and an evaporative end, the condensing end positioned within the liquid-impermeable container and the evaporative end positioned in thermal contact with the second storage region; and a third aperture in the liquid-impermeable container, the third aperture including an internal surface of a size, shape and position to mate with an external surface of the second unidirectional thermal conductor.

14. The refrigeration device of claim 1, further comprising:

one or more walls substantially forming a second liquid-impermeable container, the second liquid-impermeable container configured to hold phase change material internal to the refrigeration device;

a second set of evaporator coils affixed to the at least one active refrigeration unit, the second set of evaporator coils positioned at least partially within the second liquid-impermeable container;

a second unidirectional thermal conductor with a condensing end and an evaporative end, the condensing end positioned within the second liquid-impermeable container and the evaporative end positioned in thermal contact with the second storage region; and one or more walls substantially forming a second storage region, at least one of the one or more walls in thermal contact with the second unidirectional thermal conductor.

15. The refrigeration device of claim 1, further comprising:

one or more walls substantially forming a second liquid-impermeable container, the container configured to hold phase change material internal to the refrigeration device;

a second active refrigeration system including at least one second set of evaporator coils, the second set of evaporator coils positioned at least partially within the second liquid-impermeable container; and one or more walls substantially forming a second storage region, at least one of the one or more walls in thermal contact with the second liquid-impermeable container.

16. A refrigeration device, comprising:

one or more walls substantially forming a first liquid-impermeable container, the container configured to hold phase change material internal to the refrigeration device;

a first active refrigeration system including at least one first set of evaporator coils, the first set of evaporator coils positioned at least partially within the first liquid-impermeable container;

a first aperture in the liquid-impermeable container, the first aperture of a size, shape and position to permit the at least one first set of evaporator coils to traverse the aperture;

a unidirectional thermal conductor with a condensing end and an evaporative end, the condensing end positioned within the liquid-impermeable container;

a second aperture in the liquid-impermeable container, the second aperture including an internal surface of a size, shape and position to mate with an external surface of the unidirectional thermal conductor;

one or more walls substantially forming a first storage region, at least one of the one or more walls in thermal contact with the evaporative end of the unidirectional thermal conductor;

one or more walls substantially forming a second liquid-impermeable container, the container configured to hold phase change material internal to the refrigeration device;

a second active refrigeration system including at least one second set of evaporator coils, the second set of evaporator coils positioned at least partially within the second liquid-impermeable container; and one or more walls substantially forming a second storage region, at least one of the one or more walls in thermal contact with the second liquid-impermeable container.

17. The refrigeration device of claim 16, wherein the unidirectional thermal conductor comprises:

a thermosyphon.

18. The refrigeration device of claim 16, wherein the unidirectional thermal conductor comprises:

a heat pipe.

19. The refrigeration device of claim 16, wherein the condensing end of the unidirectional thermal conductor comprises:

a branched structure.

20. The refrigeration device of claim 16, wherein the evaporative end of the unidirectional thermal conductor comprises:

a branched structure.

21. The refrigeration device of claim 16, wherein the one or more walls substantially forming a storage region comprise:

one or more walls fabricated from a thermally conductive material, at least one of the one or more walls affixed to the evaporative end of the thermal conductor.

22. The refrigeration device of claim 16, further comprising:

a variable power control system attached to the first active refrigeration system and to the second active refrigeration system.

23. The refrigeration device of claim 16, further comprising:

a controller operably connected to both the first active refrigeration system and the second active refrigeration system.

24. The refrigeration device of claim 16, further comprising:

a temperature sensor positioned within the liquid-impermeable container, the temperature sensor connected to the active refrigeration unit.

25. The refrigeration device of claim 16, further comprising:

a temperature sensor positioned within the storage region, the temperature sensor connected to the active refrigeration unit.

26. The refrigeration device of claim 16, further comprising:

a thermal control device affixed to the unidirectional thermal conductor at a position between the condensing end and the evaporative end.

27. The refrigeration device of claim 16, further comprising:

a temperature sensor positioned within the storage region, the temperature sensor connected to a thermal control device.

28. The refrigeration device of claim 16, further comprising:

one or more sensors attached to the refrigeration device; and a transmitter attached to the one or more sensors.

29. A refrigeration device, comprising:

one or more walls substantially forming a liquid-impermeable container, the container configured to hold phase change material internal to the refrigeration device;

at least one active refrigeration unit including a set of evaporator coils, the evaporator coils positioned at least partially within the liquid-impermeable container;

a unidirectional thermal conductor including a hollow interior and an evaporative liquid within the hollow interior, the unidirectional thermal conductor with a condensing end and an evaporative end, the condensing end positioned within the liquid-impermeable container, the evaporative end including a series of angled linear segments each including a higher end and a lower end, wherein the vertical displacement between each higher end and each lower end is within a pressure head of the evaporative liquid;

a first aperture in the liquid-impermeable container, the first aperture of a size, shape and position to permit the at least one set of evaporator coils to traverse the aperture;

a second aperture in the liquid-impermeable container, the second aperture including an internal surface of a size, shape and position to mate with an external surface of the thermal conductor; and one or more walls substantially forming a storage region, at least one of the one or more walls in thermal contact with the evaporative end of the thermal conductor.

30. The refrigeration device of claim 29, wherein the unidirectional thermal conductor comprises:

a thermosyphon.

31. The refrigeration device of claim 29, wherein the unidirectional thermal conductor comprises:

a heat pipe.

32. The refrigeration device of claim 29, wherein the condensing end of the unidirectional thermal conductor comprises:

a branched structure.

33. The refrigeration device of claim 29, wherein the evaporative end of the unidirectional thermal conductor comprises:

a branched structure.

34. The refrigeration device of claim 29, wherein the unidirectional thermal conductor comprises:

an evaporative end in direct thermal contact with at least three walls of the one or more walls substantially forming a storage region.

35. The refrigeration device of claim 29, wherein the one or more walls substantially forming a storage region comprise:

one or more walls fabricated from a thermally conductive material, at least one of the one or more walls affixed to the evaporative end of the thermal conductor.

36. The refrigeration device of claim 29, further comprising:

a variable power control system attached to the at least one active refrigeration unit.

37. The refrigeration device of claim 29, further comprising:

a temperature sensor positioned within the liquid-impermeable container, the temperature sensor connected to the active refrigeration unit.

38. The refrigeration device of claim 29, further comprising:

a temperature sensor positioned within the storage region, the temperature sensor connected to the active refrigeration unit.

39. The refrigeration device of claim 29, further comprising:

a thermal control device affixed to the unidirectional thermal conductor at a position between the condensing end and the evaporative end.

40. The refrigeration device of claim 39, wherein the thermal control device includes a valve affixed to the unidirectional thermal conductor.

41. The refrigeration device of claim 39, further comprising:

a temperature sensor positioned within the storage region, the temperature sensor connected to the thermal control device.

42. The refrigeration device of claim 29, further comprising:

one or more walls substantially forming a second liquid-impermeable container, the container configured to hold phase change material internal to the refrigeration device;

a second active refrigeration system including at least one second set of evaporator coils, the second set of evaporator coils positioned at least partially within the second liquid-impermeable container; and one or more walls substantially forming a second storage region, at least one of the one or more walls in thermal contact with the second liquid-impermeable container.

43. The refrigeration device of claim 29, further comprising:

one or more sensors attached to the refrigeration device; and a transmitter attached to the one or more sensors.

* * * * *